US009404348B2

(12) United States Patent
Yeh et al.

(10) Patent No.: US 9,404,348 B2
(45) Date of Patent: Aug. 2, 2016

(54) PACKER FOR ALTERNATE FLOW CHANNEL GRAVEL PACKING AND METHOD FOR COMPLETING A WELLBORE

(75) Inventors: Charles S. Yeh, Spring, TX (US); Michael D. Barry, The Woodlands, TX (US); Michael T. Hecker, Tomball, TX (US); Tracy J. Moffett, Sugar Land, TX (US); Jon Blacklock, Kuala Lumpur (MY); David C. Haeberle, Cypress, TX (US); Patrick C. Hyde, Hurst, TX (US); Iain M. Macleod, Newmachar (GB); Lee Mercer, Kintore (GB); Stephen Reid, Aberdeen (GB); Andrew J. Elrick, Mintlaw Peterhead (GB)

(73) Assignee: ExxonMobil Upstream Research Company, Houston, TX (US)

( * ) Notice: Subject to any disclaimer, the term of this patent is extended or adjusted under 35 U.S.C. 154(b) by 519 days.

(21) Appl. No.: 13/991,852

(22) PCT Filed: Nov. 17, 2011

(86) PCT No.: PCT/US2011/061223

§ 371 (c)(1),
(2), (4) Date: Jun. 5, 2013

(87) PCT Pub. No.: WO2012/082303

PCT Pub. Date: Jun. 21, 2012

(65) Prior Publication Data

US 2013/0248179 A1 Sep. 26, 2013

Related U.S. Application Data

(60) Provisional application No. 61/424,427, filed on Dec. 17, 2010.

(51) Int. Cl.
*E21B 33/128* (2006.01)
*E21B 43/04* (2006.01)

(Continued)

(52) U.S. Cl.
CPC ..... *E21B 43/04* (2013.01); *E21B 23/06* (2013.01); *E21B 33/12* (2013.01); *E21B 33/124* (2013.01);

(Continued)

(58) Field of Classification Search
CPC ..... E21B 23/06; E21B 43/04
USPC ..... 166/183
See application file for complete search history.

(56) References Cited

U.S. PATENT DOCUMENTS 4,945,991 A 8/1990 Jones
5,113,935 A 5/1992 Jones et al.

(Continued)

FOREIGN PATENT DOCUMENTS

CN 201152161 Y 11/2008

OTHER PUBLICATIONS

Barry, M. D., et al., (2007), "Openhole Gravel Packing with Zonal Isolation," SPE-110460, *SPE Annual Technical Conference and Exhibition*, pp. 1-10.

(Continued)

*Primary Examiner* — David Andrews
*Assistant Examiner* — Ronald Runyan

(57) ABSTRACT

Apparatus and method for completing a wellbore including providing a packer having an inner mandrel, alternate flow channels along the inner mandrel, and a sealing element external to the inner mandrel, including connecting packer to tubular body, then running the packer and connected tubular body into the wellbore. In one aspect, the packer and connected tubular body may be placed along an open-hole portion of the wellbore. Tubular body may be a sand screen, with the sand screen comprising a base pipe, a surrounding filter medium, and alternate flow channels. The method includes setting a packer and injecting a gravel slurry into an annular region formed between the tubular body and the surrounding wellbore, and then further injecting the gravel slurry through the alternate flow channels to allow the gravel slurry to at least partially bypass sealing element of the packer.

41 Claims, 24 Drawing Sheets

(51) Int. Cl.

| | |
|---|---|
| ***E21B 23/06*** | (2006.01) |
| ***E21B 33/124*** | (2006.01) |
| ***E21B 33/1295*** | (2006.01) |
| ***E21B 33/12*** | (2006.01) |
| ***E21B 33/126*** | (2006.01) |
| ***E21B 43/00*** | (2006.01) |
| ***E21B 43/16*** | (2006.01) |

(52) U.S. Cl.

CPC ..... *E21B 33/126* (2013.01); *E21B 33/1295* (2013.01); *E21B 43/00* (2013.01); *E21B 43/16* (2013.01)

(56) References Cited

U.S. PATENT DOCUMENTS

| | | | |
|---|---|---|---|
| 5,348,091 | A | 9/1994 | Tchakarov et al. |
| 5,390,966 | A | 2/1995 | Cox et al. |
| 5,396,954 | A | 3/1995 | Brooks |
| 5,476,143 | A | 12/1995 | Sparlin et al. |
| 5,588,487 | A | 12/1996 | Bryant |
| 5,636,689 | A | 6/1997 | Rubbo et al. |
| 5,868,200 | A | 2/1999 | Bryant et al. |
| 5,887,660 | A | 3/1999 | Yokley et al. |
| 5,909,774 | A | 6/1999 | Griffith et al. |
| 5,975,205 | A | 11/1999 | Carisella |
| 6,003,834 | A | 12/1999 | Read |
| 6,179,056 | B1 | 1/2001 | Smith |
| 6,298,916 | B1 | 10/2001 | Tibbles et al. |
| 6,325,144 | B1 | 12/2001 | Turley et al. |
| 6,354,378 | B1 | 3/2002 | Patel |
| 6,409,219 | B1 | 6/2002 | Broome et al. |
| 6,464,261 | B1 | 10/2002 | Dybevik et al. |
| 6,513,599 | B1 | 2/2003 | Bixenman et al. |
| 6,516,881 | B2 | 2/2003 | Hailey, Jr. |
| 6,520,254 | B2 | 2/2003 | Hurst et al. |
| 6,557,634 | B2 | 5/2003 | Hailey, Jr. et al. |
| 6,575,251 | B2 | 6/2003 | Watson et al. |
| 6,581,689 | B2 | 6/2003 | Hailey, Jr. |
| 6,601,646 | B2 | 8/2003 | Streich et al. |
| 6,644,404 | B2 | 11/2003 | Schultz et al. |
| 6,666,274 | B2 | 12/2003 | Hughes |
| 6,695,067 | B2 | 2/2004 | Johnson et al. |
| 6,705,402 | B2 | 3/2004 | Proctor |
| 6,749,023 | B2 | 6/2004 | Nguyen et al. |
| 6,749,024 | B2 | 6/2004 | Bixenman |
| 6,752,206 | B2 | 6/2004 | Watson et al. |
| 6,752,207 | B2 | 6/2004 | Danos et al. |
| 6,755,245 | B2 | 6/2004 | Nguyen et al. |
| 6,789,621 | B2 | 9/2004 | Wetzel et al. |
| 6,789,623 | B2 | 9/2004 | Hill, Jr. et al. |
| 6,789,624 | B2 | 9/2004 | McGregor et al. |
| 6,814,139 | B2 | 11/2004 | Hejl et al. |
| 6,817,410 | B2 | 11/2004 | Wetzel et al. |
| 6,830,104 | B2 | 12/2004 | Nguyen et al. |
| 6,883,608 | B2 | 4/2005 | Parlar et al. |
| 6,923,262 | B2 | 8/2005 | Broome et al. |
| 6,935,432 | B2 | 8/2005 | Nguyen |
| 6,983,796 | B2 | 1/2006 | Bayne et al. |
| 6,986,390 | B2 | 1/2006 | Doanne et al. |
| 6,997,263 | B2 | 2/2006 | Campbell et al. |
| 7,044,231 | B2 | 5/2006 | Doane et al. |
| 7,048,061 | B2 | 5/2006 | Bode et al. |
| 7,051,805 | B2 | 5/2006 | Doane et al. |
| 7,055,598 | B2 | 6/2006 | Ross et al. |
| 7,096,945 | B2 | 8/2006 | Richards et al. |
| 7,100,691 | B2 | 9/2006 | Nguyen et al. |
| 7,104,324 | B2 | 9/2006 | Wetzel et al. |
| 7,147,054 | B2 | 12/2006 | Wang et al. |
| 7,152,677 | B2 | 12/2006 | Parlar et al. |
| 7,207,383 | B2 | 4/2007 | Hurst et al. |
| 7,222,676 | B2 | 5/2007 | Patel et al. |
| 7,243,715 | B2 | 7/2007 | Wang et al. |
| 7,243,723 | B2 | 7/2007 | Surjaatmadja et al. |
| 7,243,724 | B2 | 7/2007 | McGregor et al. |
| 7,243,732 | B2 | 7/2007 | Richard |
| 7,252,142 | B2 | 8/2007 | Brezinski et al. |
| 7,264,061 | B2 | 9/2007 | Dybevik et al. |
| 7,278,479 | B2 | 10/2007 | Kvernstuen et al. |
| 7,343,983 | B2 | 3/2008 | Livingstone |
| 7,363,974 | B2 | 4/2008 | Wang et al. |
| 7,367,395 | B2 | 5/2008 | Vidrine et al. |
| 7,370,700 | B2 | 5/2008 | Hurst et al. |
| 7,373,978 | B2 | 5/2008 | Barry et al. |
| 7,392,852 | B2 | 7/2008 | Richard |
| 7,407,007 | B2 | 8/2008 | Tibbles |
| 7,426,962 | B2 | 9/2008 | Moen et al. |
| 7,431,058 | B2 | 10/2008 | Holting |
| 7,431,085 | B2 | 10/2008 | Coronado et al. |
| 7,431,091 | B2 | 10/2008 | Themig et al. |
| 7,431,098 | B2 | 10/2008 | Ohmer et al. |
| 7,441,605 | B2 | 10/2008 | Coronado et al. |
| 7,493,959 | B2 | 2/2009 | Johnson et al. |
| 7,497,267 | B2 | 3/2009 | Setterberg, Jr. et al. |
| 7,562,709 | B2 | 7/2009 | Saebi et al. |
| 7,584,799 | B2 | 9/2009 | Coronado et al. |
| 7,591,321 | B2 | 9/2009 | Whitsitt et al. |
| 7,597,141 | B2 | 10/2009 | Rouse et al. |
| 7,624,810 | B2 | 12/2009 | Fould et al. |
| 7,661,476 | B2 | 2/2010 | Yeh et al. |
| 7,681,652 | B2 | 3/2010 | Gaudette et al. |
| 7,735,559 | B2 | 6/2010 | Malone |
| 7,828,056 | B2 | 11/2010 | Dybevik et al. |
| 7,832,472 | B2 | 11/2010 | Themig |
| 7,886,819 | B2 | 2/2011 | Setterberg, Jr. et al. |
| 7,938,184 | B2 | 5/2011 | Yeh et al. |
| 7,971,642 | B2 | 7/2011 | Yeh et al. |
| 8,215,406 | B2 | 7/2012 | Dale et al. |
| 2003/0127227 | A1 | 7/2003 | Fehr et al. |
| 2003/0173075 | A1 | 9/2003 | Morvant et al. |
| 2004/0007829 | A1 | 1/2004 | Ross |
| 2004/0140089 | A1 | 7/2004 | Gunneroed |
| 2005/0023004 | A1* | 2/2005 | King ..... E21B 23/06 166/387 |
| 2005/0028977 | A1 | 2/2005 | Ward |
| 2005/0039917 | A1 | 2/2005 | Hailey, Jr. |
| 2005/0061501 | A1 | 3/2005 | Ward et al. |
| 2005/0082060 | A1 | 4/2005 | Ward et al. |
| 2005/0241855 | A1 | 11/2005 | Wylie et al. |
| 2005/0263287 | A1 | 12/2005 | Achee, Jr. et al. |
| 2007/0056750 | A1 | 3/2007 | John et al. |
| 2008/0066900 | A1* | 3/2008 | Saebi ..... E21B 43/04 166/51 |
| 2008/0125335 | A1 | 5/2008 | Bhavsar |
| 2008/0128126 | A1 | 6/2008 | Dagenais et al. |
| 2008/0142222 | A1 | 6/2008 | Howard et al. |
| 2008/0314589 | A1 | 12/2008 | Guignard et al. |
| 2009/0008084 | A1 | 1/2009 | Dybevik et al. |
| 2009/0084556 | A1 | 4/2009 | Richards et al. |
| 2009/0159279 | A1 | 6/2009 | Assal |
| 2009/0159298 | A1 | 6/2009 | Assal |
| 2009/0283279 | A1 | 11/2009 | Patel et al. |
| 2009/0294128 | A1* | 12/2009 | Dale ..... E21B 43/04 166/306 |
| 2009/0308592 | A1 | 12/2009 | Mercer et al. |
| 2010/0032158 | A1 | 2/2010 | Dale et al. |
| 2010/0065284 | A1 | 3/2010 | Freyer |
| 2010/0096119 | A1 | 4/2010 | Sevre et al. |
| 2010/0147538 | A1 | 6/2010 | Gaudette et al. |
| 2010/0155064 | A1 | 6/2010 | Nutley et al. |
| 2010/0218948 | A1 | 9/2010 | Mickelburgh et al. |
| 2010/0252252 | A1 | 10/2010 | Harris et al. |
| 2011/0042106 | A1 | 2/2011 | MacLeod |
| 2011/0284208 | A1 | 11/2011 | MacLeod et al. |
| 2012/0018153 | A1 | 1/2012 | Yeh et al. |

OTHER PUBLICATIONS

Hecker, M. T., et al., (2004), "Reducing Well Cost by Gravel Packing in Nonaqueous Fluid," SPE-90758, *SPE AnnualTechnical Conference and Exhibition*, pp. 1-7.

Hecker, M. T., et al., (2010), Extending Openhole Gravel Packing Capability: Initial Field Installation of Internal Shunt Alternate Path Technology, SPE-135102, *SPE AnnualTechnical Conference and Exhibition*, pp. 1-6.

(56) References Cited

OTHER PUBLICATIONS

Hurst, G., et al., (2004), "Alternate Path Completions: A Critical Review and Lessons Learned From Case Histories With Recommended Practices for Deepwater Applications", SPE-86532, *SPE Internatinal Symposium and Exhibition*, pp. 1-14.

* cited by examiner

PACKER FOR ALTERNATE FLOW CHANNEL GRAVEL PACKING AND METHOD FOR COMPLETING A WELLBORE

CROSS REFERENCE TO RELATED APPLICATIONS

This application is the National Stage of International Application No. PCT/US2011/061223, filed Nov. 17, 2011, which claims the benefit of U.S. Provisional Application No. 61/424,427, filed Dec. 17 2010, the entirety of which is incorporated herein by reference for all purposes.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of well completions. More specifically, the present invention relates to the isolation of formations in connection with wellbores that have been completed using gravel-packing. The application also relates to a downhole packer that may be set within either a cased hole or an open-hole wellbore and which incorporates Alternate Path® technology.

DISCUSSION OF TECHNOLOGY

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of the formation behind the casing.

It is common to place several strings of casing having progressively smaller outer diameters into the wellbore. The process of drilling and then cementing progressively smaller strings of casing is repeated several times until the well has reached total depth. The final string of casing, referred to as a production casing, is cemented in place and perforated. In some instances, the final string of casing is a liner, that is, a string of casing that is not tied back to the surface.

As part of the completion process, a wellhead is installed at the surface. The wellhead controls the flow of production fluids to the surface, or the injection of fluids into the wellbore. Fluid gathering and processing equipment such as pipes, valves and separators are also provided. Production operations may then commence.

It is sometimes desirable to leave the bottom portion of a wellbore open. In open-hole completions, a production casing is not extended through the producing zones and perforated; rather, the producing zones are left uncased, or "open." A production string or "tubing" is then positioned inside the wellbore extending down below the last string of casing and across a subsurface formation.

There are certain advantages to open-hole completions versus cased-hole completions. First, because open-hole completions have no perforation tunnels, formation fluids can converge on the wellbore radially 360 degrees. This has the benefit of eliminating the additional pressure drop associated with converging radial flow and then linear flow through particle-filled perforation tunnels. The reduced pressure drop associated with an open-hole completion virtually guarantees that it will be more productive than an unstimulated, cased hole in the same formation.

Second, open-hole techniques are oftentimes less expensive than cased hole completions. For example, the use of gravel packs eliminates the need for cementing, perforating, and post-perforation clean-up operations.

A common problem in open-hole completions is the immediate exposure of the wellbore to the surrounding formation. If the formation is unconsolidated or heavily sandy, the flow of production fluids into the wellbore may carry with it formation particles, e.g., sand and fines. Such particles can be erosive to production equipment downhole and to pipes, valves and separation equipment at the surface.

To control the invasion of sand and other particles, sand control devices may be employed. Sand control devices are usually installed downhole across formations to retain solid materials larger than a certain diameter while allowing fluids to be produced. A sand control device typically includes an elongated tubular body, known as a base pipe, having numerous slotted openings. The base pipe is then typically wrapped with a filtration medium such as a screen or wire mesh.

To augment sand control devices, particularly in open-hole completions, it is common to install a gravel pack. Gravel packing a well involves placing gravel or other particulate matter around the sand control device after the sand control device is hung or otherwise placed in the wellbore. To install a gravel pack, a particulate material is delivered downhole by means of a carrier fluid. The carrier fluid with the gravel together forms a gravel slurry. The slurry dries in place, leaving a circumferential packing of gravel. The gravel not only aids in particle filtration but also helps maintain formation integrity.

In an open-hole gravel pack completion, the gravel is positioned between a sand screen that surrounds a perforated base pipe and a surrounding wall of the wellbore. During production, formation fluids flow from the subterranean formation, through the gravel, through the screen, and into the inner base pipe. The base pipe thus serves as a part of the production string.

A problem historically encountered with gravel-packing is that an inadvertent loss of carrier fluid from the slurry during the delivery process can result in premature sand or gravel bridges being formed at various locations along open-hole intervals. For example, in an inclined production interval or an interval having an enlarged or irregular borehole, a poor distribution of gravel may occur due to a premature loss of carrier fluid from the gravel slurry into the formation. Premature sand bridging can block the flow of gravel slurry, causing voids to form along the completion interval. Thus, a complete gravel-pack from bottom to top is not achieved, leaving the wellbore exposed to sand and fines infiltration.

The problems of sand bridging has been addressed through the use of Alternate Path® Technology, or "APT." Alternate Path® Technology employs shunt tubes (or shunts) that allow the gravel slurry to bypass selected areas along a wellbore. Such alternate path technology is described, for example, in U.S. Pat. No. 5,588,487 entitled "Tool for Blocking Axial Flow in Gravel-Packed Well Annulus," and U.S. Pat. No. 7,938,184 entitled "Wellbore Method and Apparatus for Completion, Production, and Injection". Additional references which discuss bypass technology include U.S. Pat. Nos. 4,945,991; 5,113,935; 7,661,476; and M.D. Barry, et al., "Open-hole Gravel Packing with Zonal Isolation," SPE Paper No. 110,460 (November 2007).

The efficacy of a gravel pack in controlling the influx of sand and fines into a wellbore is well-known. However, it is also sometimes desirable with open-hole completions to isolate selected intervals along the open-hole portion of a wellbore in order to control the inflow of fluids. For example, in connection with the production of condensable hydrocarbons, water may sometimes invade an interval. This may be due to the presence of native water zones, coning (rise of near-well hydrocarbon-water contact), high permeability streaks, natural fractures, or fingering from injection wells. Depending on the mechanism or cause of the water production, the water may be produced at different locations and times during a well's lifetime. Similarly, a gas cap above an oil reservoir may expand and break through, causing gas production with oil. The gas breakthrough reduces gas cap drive and suppresses oil production.

In these and other instances, it is desirable to isolate an interval from the production of formation fluids into the wellbore. Annular zonal isolation may also be desired for production allocation, production/injection fluid profile control, selective stimulation, or water or gas control. However, the design and installation of open-hole packers is highly problematic due to under-reamed areas, areas of washout, higher pressure differentials, frequent pressure cycling, and irregular borehole sizes. In addition, the longevity of zonal isolation is a consideration as the water/gas coning potential often increases later in the life of a field due to pressure drawdown and depletion.

Therefore, a need exists for an improved sand control system that provides bypass technology for the placement of gravel that bypasses a packer. A need further exists for a packer assembly that provides isolation of selected subsurface intervals along an open-hole wellbore. Further, a need exists for a packer that utilizes alternate path channels, and that provides a hydraulic seal to an open-hole wellbore before any gravel is placed around the sealing element.

SUMMARY OF THE INVENTION

A specially-designed downhole packer is first offered herein. The downhole packer may be used to seal an annular region between a tubular body and a surrounding open-hole wellbore. The downhole packer may be placed along a string of sand control devices, and set before a gravel packing operation begins.

In one embodiment, the downhole packer comprises an inner mandrel. The inner mandrel defines an elongated tubular body. In addition, the downhole packer has at least one alternate flow channel along the inner mandrel. Further, the downhole packer has a sealing element external to the inner mandrel. The sealing element resides circumferentially around the inner mandrel.

The downhole packer further includes a movable piston housing. The piston housing is initially retained around the inner mandrel. The piston housing has a pressure-bearing surface at a first end, and is operatively connected to the sealing element. The piston housing may be released and caused to move along the inner mandrel. Movement of the piston housing actuates the sealing element into engagement with the surrounding open-hole wellbore.

Preferably, the downhole packer further includes a piston mandrel. The piston mandrel is disposed between the inner mandrel and the surrounding piston housing. An annulus is preserved between the inner mandrel and the piston mandrel. The annulus beneficially serves as the at least one alternate flow channel through the packer.

The downhole packer may also include one or more flow ports. The flow ports provide fluid communication between the alternate flow channel and the pressure-bearing surface of the piston housing. The flow ports are sensitive to hydrostatic pressure within the wellbore.

In one embodiment, the downhole packer also includes a release sleeve. The release sleeve resides along an inner surface of the inner mandrel. Further, the downhole packer includes a release key. The release key is connected to the release sleeve. The release key is movable between a retaining position wherein the release key engages and retains the moveable piston housing in place, to a releasing position wherein the release key disengages the piston housing. When disengaged, absolute pressure acts against the pressure-bearing surface of the piston housing and moves the piston housing to actuate the sealing element.

In one aspect, the downhole packer also has at least one shear pin. The at least one shear pin may be one or more set screws. The shear pin or pins releasably connects the release sleeve to the release key. The shear pin or pins is sheared when a setting tool is pulled up the inner mandrel and slides the release sleeve.

In one embodiment, the downhole packer also has a centralizer. The centralizer may be operable in response to manipulation of the packer or sealing mechanism, or in other embodiments be operable separately from manipulating the packer or sealing mechanism.

A method for completing a wellbore is also provided herein. The wellbore may include a lower portion completed as an open-hole. In one aspect, the method includes providing a packer. The packer may be in accordance with the packer described above. For example, the packer will have an inner mandrel, alternate flow channels around the inner mandrel, and a sealing element external to the inner mandrel. The sealing element is preferably an elastomeric cup-type element The method also includes connecting the packer to a tubular body, and then running the packer and connected tubular body into the wellbore. The packer and connected tubular body are placed along the open-hole portion of the wellbore. Preferably, the tubular body is a sand screen, with the sand screen comprising a base pipe, a surrounding filter medium, and alternate flow channels. Alternatively, the tubular body may be a blank pipe comprising alternate flow channels. The alternate flow channels may be either internal or external to the filter medium or the blank pipe, as the case may be.

The base pipe of the sand screen may be made up of a plurality of joints. For example, the packer may be connected between two of the plurality of joints of the base pipe.

The method also includes setting the packer. This is done by actuating the sealing element of the packer into engagement with the surrounding open-hole portion of the wellbore. As an alternative, the packer may be set along a non-perforated joint of casing. Thereafter, the method includes injecting a gravel slurry into an annular region formed between the tubular body and the surrounding wellbore, and then further injecting the gravel slurry through the alternate flow channels to allow the gravel slurry to bypass the sealing element. In this way, the open-hole portion of the wellbore is gravel-packed below the packer. In one aspect, the wellbore is gravel packed above and below the packer after the packer has been completely set in the open-hole wellbore.

In one embodiment herein, the packer is a first mechanically-set packer that is part of a packer assembly. In this instance, the packer assembly may comprise a second mechanically-set packer constructed in accordance with the first packer. The step of further injecting the gravel slurry through the alternate flow channels allows the gravel slurry to bypass the sealing element of the packer assembly so that the open-hole portion of the wellbore is gravel-packed above and below the packer assembly after the first and second mechanically-set packers have been set in the wellbore.

The method may further include running a setting tool into the inner mandrel of the packer, and releasing the movable piston housing from its retained position. The method then includes communicating hydrostatic pressure to the piston housing through the one or more flow ports. Communicating hydrostatic pressure moves the released piston housing and actuates the sealing element against the surrounding wellbore.

It is preferred that the setting tool is part of a washpipe used for gravel packing. In this instance, running the setting tool comprises running a washpipe into a bore within the inner mandrel of the packer, with the washpipe having a setting tool thereon. The step of releasing the movable piston housing from its retained position then comprises pulling the washpipe with the setting tool along the inner mandrel. The release sleeve moves to shear the at least one shear pin and shift the release sleeve. This further serves to free the at least one release key, and release the piston housing.

The method may also include producing hydrocarbon fluids from at least one interval along the open-hole portion of the wellbore.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
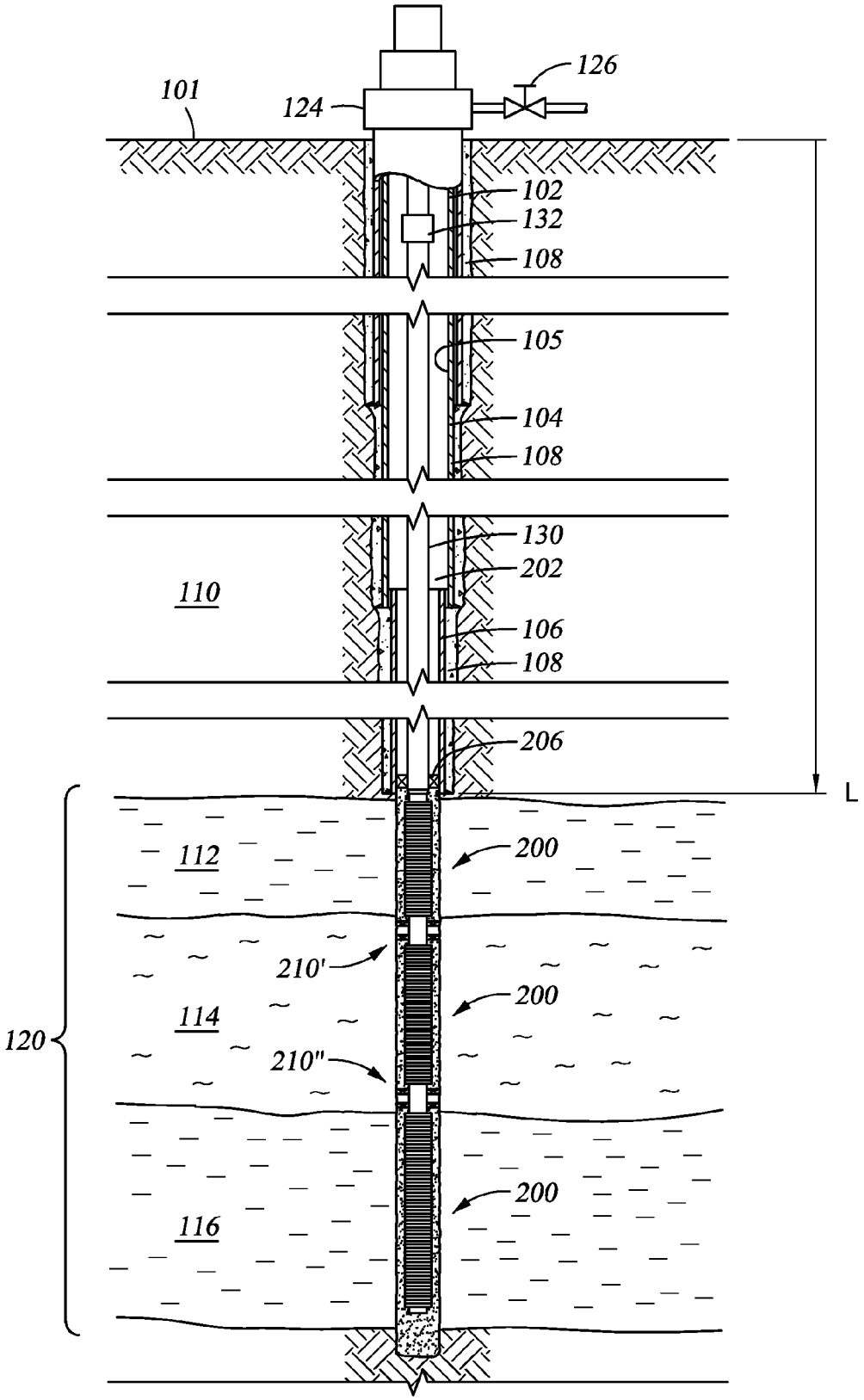
FIG. 1 is a cross-sectional view of an illustrative wellbore. The wellbore has been drilled through three different subsurface intervals, each interval being under formation pressure and containing fluids.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

As used herein, the term "wellbore" refers to a hole in the subsurface made by drilling or insertion of a conduit into the subsurface. A wellbore may have a substantially circular cross section, or other cross-sectional shape. As used herein, the term "well", when referring to an opening in the formation, may be used interchangeably with the term "wellbore."

The term "tubular member" refers to any pipe, such as a joint of casing, a portion of a liner, or a pup joint.

The term "sand control device" means any elongated tubular body that permits an inflow of fluid into an inner bore or a base pipe while filtering out predetermined sizes of sand, fines and granular debris from a surrounding formation.

The term "alternate flow channels" means any collection of manifolds and/or shunt tubes that provide fluid communication through or around a downhole tool such as a packer to allow a slurry to by-pass the packer or any premature sand bridge in an annular region and continue gravel packing below, or above and below, the tool.

Description of Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells commonly are completed in substantially vertical orientation, it is understood that wells may also be inclined and or even horizontally completed. When the descriptive terms "up and down" or "upper" and "lower" or similar terms are used in reference to a drawing or in the claims, they are intended to indicate relative location on the drawing page or with respect to claim terms, and not necessarily orientation in the ground, as the present inventions have utility no matter how the wellbore is orientated.

FIG. 1 is a cross-sectional view of an illustrative wellbore 100. The wellbore 100 defines a bore 105 that extends from a surface 101, and into the earth's subsurface 110. The wellbore 100 is completed to have an open-hole portion 120 at a lower end of the wellbore 100. The wellbore 100 has been formed for the purpose of producing hydrocarbons for commercial sale. A string of production tubing 130 is provided in the bore 105 to transport production fluids from the open-hole portion 120 up to the surface 101.

The wellbore 100 includes a well tree, shown schematically at 124. The well tree 124 includes a shut-in valve 126. The shut-in valve 126 controls the flow of production fluids from the wellbore 100. In addition, a subsurface safety valve 132 is provided to block the flow of fluids from the production tubing 130 in the event of a rupture or catastrophic event above the subsurface safety valve 132. The wellbore 100 may optionally have a pump (not shown) within or just above the open-hole portion 120 to artificially lift production fluids from the open-hole portion 120 up to the well tree 124.

The wellbore 100 has been completed by setting a series of pipes into the subsurface 110. These pipes include a first string of casing 102, sometimes known as surface casing or a conductor. These pipes also include at least a second 104 and a third 106 string of casing. These casing strings 104, 106 are intermediate casing strings that provide support for walls of the wellbore 100. Intermediate casing strings 104, 106 may be hung from the surface, or they may be hung from a next higher casing string using an expandable liner or liner hanger. It is understood that a pipe string that does not extend back to the surface (such as casing string 106) is normally referred to as a "liner."

In the illustrative wellbore arrangement of FIG. 1, intermediate casing string 104 is hung from the surface 101, while casing string 106 is hung from a lower end of casing string 104. Additional intermediate casing strings (not shown) may be employed. The present inventions are not limited to the type of casing arrangement used.

Each string of casing 102, 104, 106 is set in place through cement 108. The cement 108 isolates the various formations of the subsurface 110 from the wellbore 100 and each other. The cement 108 extends from the surface 101 to a depth "L" at a lower end of the casing string 106. It is understood that some intermediate casing strings may not be fully cemented.

An annular region 204 is formed between the production tubing 130 and the casing string 106. A production packer 206 seals the annular region 204 near the lower end "L" of the casing string 106.

In many wellbores, a final casing string known as production casing is cemented into place at a depth where subsurface production intervals reside. However, the illustrative wellbore 100 is completed as an open-hole wellbore. Accordingly, the wellbore 100 does not include a final casing string along the open-hole portion 120.

In the illustrative wellbore 100, the open-hole portion 120 traverses three different subsurface intervals. These are indicated as upper interval 112, intermediate interval 114, and lower interval 116. Upper interval 112 and lower interval 116 may, for example, contain valuable oil deposits sought to be produced, while intermediate interval 114 may contain primarily water or other aqueous fluid within its pore volume. This may be due to the presence of native water zones, high permeability streaks or natural fractures in the aquifer, or fingering from injection wells. In this instance, there is a probability that water will invade the wellbore 100.

Alternatively, upper 112 and intermediate 114 intervals may contain hydrocarbon fluids sought to be produced, processed and sold, while lower interval 116 may contain some oil along with ever-increasing amounts of water. This may be due to coning, which is a rise of near-well hydrocarbon-water contact. In this instance, there is again the possibility that water will invade the wellbore 100.

Alternatively still, upper 112 and lower 116 intervals may be producing hydrocarbon fluids from a sand or other permeable rock matrix, while intermediate interval 114 may represent a non-permeable shale or otherwise be substantially impermeable to fluids.

In any of these events, it is desirable for the operator to isolate selected intervals. In the first instance, the operator will want to isolate the intermediate interval 114 from the production string 130 and from the upper 112 and lower 116 intervals so that primarily hydrocarbon fluids may be produced through the wellbore 100 and to the surface 101. In the second instance, the operator will eventually want to isolate the lower interval 116 from the production string 130 and the upper 112 and intermediate 114 intervals so that primarily hydrocarbon fluids may be produced through the wellbore 100 and to the surface 101. In the third instance, the operator will want to isolate the upper interval 112 from the lower interval 116, but need not isolate the intermediate interval 114. Solutions to these needs in the context of an open-hole completion are provided herein, and are demonstrated more fully in connection with the proceeding drawings.

In connection with the production of hydrocarbon fluids from a wellbore having an open-hole completion, it is not only desirable to isolate selected intervals, but also to limit the influx of sand particles and other fines. In order to prevent the migration of formation particles into the production string 130 during operation, sand control devices 200 have been run into the wellbore 100. These are described more fully below in connection with FIG. 2 and with FIGS. 8A through 8J.

Figure 2:
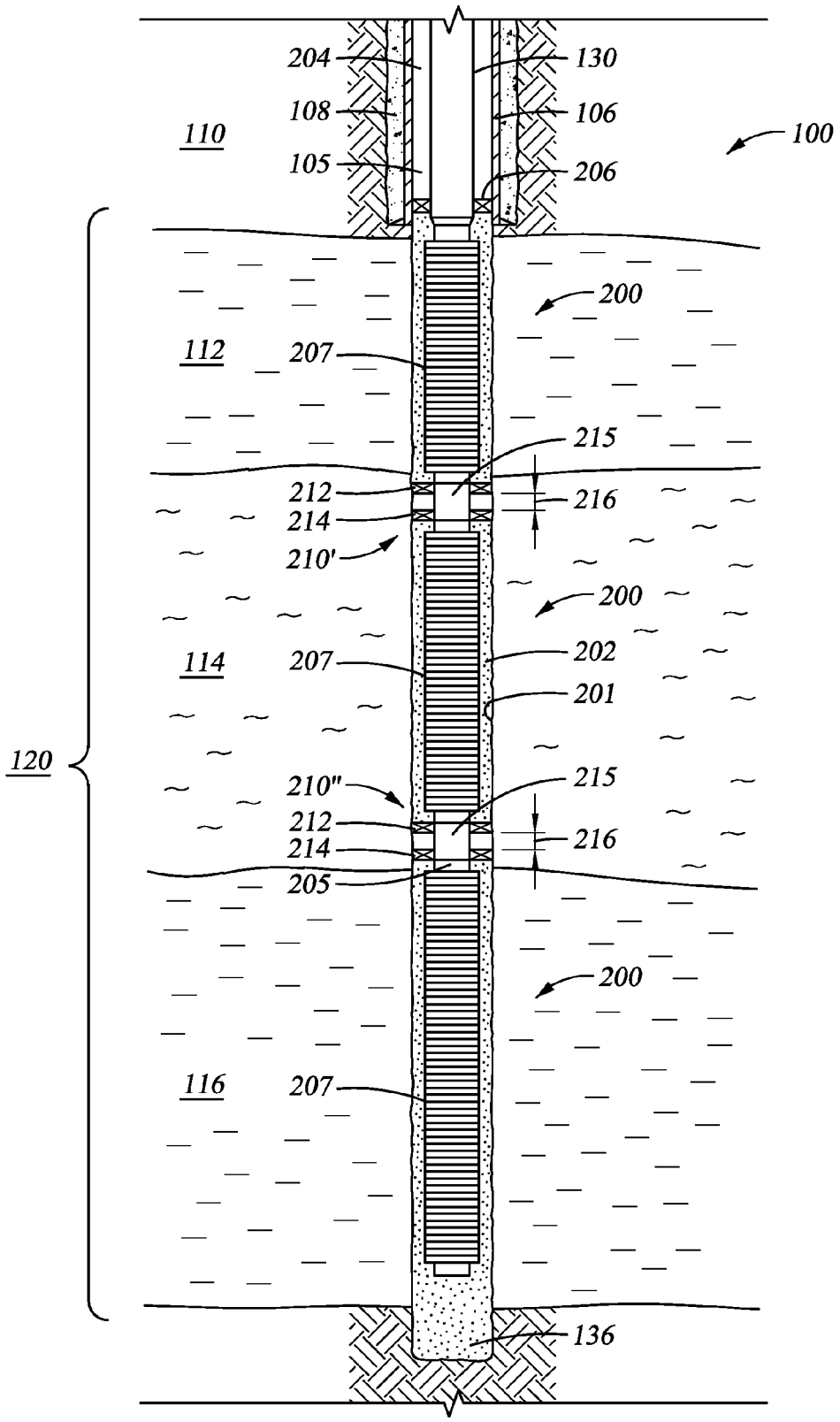
FIG. 2 is an enlarged cross-sectional view of an open-hole completion of the wellbore of FIG. 1. The open-hole completion at the depth of the three illustrative intervals is more clearly seen.

Referring now to FIG. 2, the sand control devices 200 contain an elongated tubular body referred to as a base pipe 205. The base pipe 205 typically is made up of a plurality of pipe joints. The base pipe 205 (or each pipe joint making up the base pipe 205) typically has small perforations or slots to permit the inflow of production fluids.

The sand control devices 200 also contain a filter medium 207 wound or otherwise placed radially around the base pipes 205. The filter medium 207 may be a wire mesh screen or wire wrap fitted around the base pipe 205. The filter medium 207 prevents the inflow of sand or other particles above a predetermined size into the base pipe 205 and the production tubing 130.

In addition to the sand control devices 200, the wellbore 100 includes one or more packer assemblies 210. In the illustrative arrangement of FIGS. 1 and 2, the wellbore 100 has an upper packer assembly 210' and a lower packer assembly 210". However, additional packer assemblies 210 or just one packer assembly 210 may be used. The packer assemblies 210', 210" are uniquely configured to seal an annular region (seen at 202 of FIG. 2) between the various sand control devices 200 and a surrounding wall 201 of the open-hole portion 120 of the wellbore 100.

FIG. 2 is an enlarged cross-sectional view of the open-hole portion 120 of the wellbore 100 of FIG. 1. The open-hole portion 120 and the three intervals 112, 114, 116 are more clearly seen. The upper 210' and lower 210" packer assemblies are also more clearly visible proximate upper and lower boundaries of the intermediate interval 114, respectively. Finally, the sand control devices 200 along each of the intervals 112, 114, 116 are shown.

Concerning the packer assemblies themselves, each packer assembly 210', 210" may have at least two packers. The packers are preferably set through a combination of mechanical manipulation and hydraulic forces. The packer assemblies 210 represent an upper packer 212 and a lower packer 214. Each packer 212, 214 has an expandable portion or element fabricated from an elastomeric or a thermoplastic material capable of providing at least a temporary fluid seal against the surrounding wellbore wall 201.

The elements for the upper 212 and lower 214 packers should be able to withstand the pressures and loads associated with a gravel packing process. Typically, such pressures are from about 2,000 psi to 3,000 psi. The elements of the packers 212, 214 should also withstand pressure load due to differential wellbore and/or reservoir pressures caused by natural faults, depletion, production, or injection. Production operations may involve selective production or production allocation to meet regulatory requirements. Injection operations may involve selective fluid injection for strategic reservoir pressure maintenance. Injection operations may also involve selective stimulation in acid fracturing, matrix acidizing, or formation damage removal.

The sealing surface or elements for the mechanically set packers 212, 214 need only be on the order of inches to affect a suitable hydraulic seal. In one aspect, the elements are each about 6 inches (15.2 cm) to about 24 inches (70.0 cm) in length.

The elements for the packers 212, 214 are preferably cup-type elements. Cup-type elements are well known for use in cased-hole completions. However, they generally are not known for use in open-hole completions as they are not engineered to expand into engagement with an open-hole diameter. The preferred cup-type nature of the sealing surfaces of the packer elements 212, 214 will assist in maintaining at least a temporary seal against the wall 201 of the intermediate interval 114 (or other interval) as pressure increases during the gravel packing operation.

The upper 212 and lower 214 packers are set prior to a gravel pack installation process. As described more fully below, the packers 212, 214 may be set by sliding a release sleeve. This, in turn, allows hydrostatic pressure to act downwardly against a piston mandrel. The piston mandrel acts down upon a centralizer and/or packer elements, causing the same to expand against the wellbore wall 201. The expandable portions of the upper 212 and lower 214 packers are expanded into contact with the surrounding wall 201 so as to straddle the annular region 202 at a selected depth along the open-hole completion 120.

FIG. 2 shows a mandrel at 215. This may be representative of the piston mandrel, and other mandrels used in the packers 212, 214 as described more fully below.

The upper 212 and lower 214 packers may generally be mirror images of each other, except for the release sleeves or other engagement mechanisms. Unilateral movement of a shifting tool (shown in and discussed in connection with FIGS. 7A and 7B) will allow the packers 212, 214 to be activated in sequence or simultaneously. The lower packer 214 is activated first, followed by the upper packer 212 as the shifting tool is pulled upward through an inner mandrel (shown in and discussed in connection with FIGS. 6A and 6B). A short spacing is preferably provided between the upper 212 and lower 214 packers.

The packer assemblies 210', 210" help control and manage fluids produced from different zones. In this respect, the packer assemblies 210', 210" allow the operator to seal off an interval from either production or injection, depending on well function. Installation of the packer assemblies 210', 210" in the initial completion allows an operator to shut-off the production from one or more zones during the well lifetime to limit the production of water or, in some instances, an undesirable non-condensable fluid such as hydrogen sulfide.

Packers historically have not been installed when an open-hole gravel pack is utilized because of the difficulty in forming a seal along an open-hole portion, and because of the difficulty in forming a complete gravel pack above and below the packer. Related patent applications, U.S. Publication Nos. 2009/0294128 and 2010/0032158 disclose apparatus' and methods for gravel-packing an open-hole wellbore after a packer has been set at a completion interval. Zonal isolation in open-hole, gravel-packed completions may be provided by using a packer element and secondary (or "alternate") flow paths to enable both zonal isolation and alternate flow path gravel packing.

Certain technical challenges have remained with respect to the methods disclosed in U.S. Pub Nos. 2009/0294128 and 2010/0032158, particularly in connection with the packer. The applications state that the packer may be a hydraulically actuated inflatable element. Such an inflatable element may be fabricated from an elastomeric material or a thermoplastic material. However, designing a packer element from such materials requires the packer element to meet a particularly high performance level. In this respect, the packer element needs to be able to maintain zonal isolation for a period of years in the presence of high pressures and/or high temperatures and/or acidic fluids. As an alternative, the applications state that the packer may be a swelling rubber element that expands in the presence of hydrocarbons, water, or other stimulus. However, known swelling elastomers typically require about 30 days or longer to fully expand into sealed fluid engagement with the surrounding rock formation. Therefore, improved packers and zonal isolation apparatus' are offered herein.

Figure 3A:
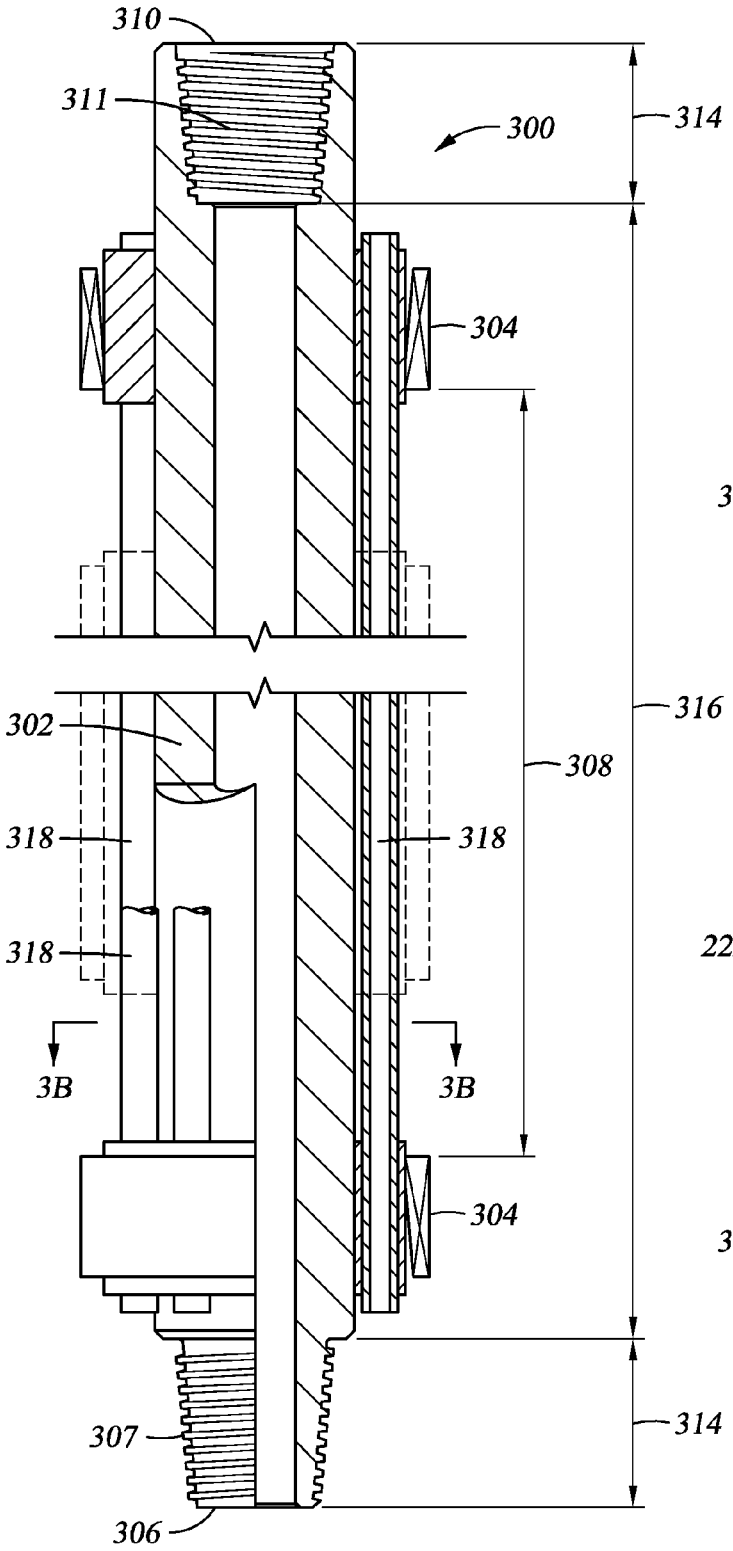
FIG. 3A is a cross-sectional side view of a packer assembly, in one embodiment. Here, a base pipe is shown, with surrounding packer elements. Two mechanically set packers are shown in spaced-apart relation.

FIG. 3A presents an illustrative packer assembly 300 providing an alternate flowpath for a gravel slurry. The packer assembly 300 is seen in cross-sectional side view. The packer assembly 300 includes various components that may be utilized to seal an annulus along the open-hole portion 120.

The packer assembly 300 first includes a main body section 302. The main body section 302 is preferably fabricated from steel or from steel alloys. The main body section 302 is configured to be a specific length 316, such as about 40 feet (12.2 meters). The main body section 302 comprises individual pipe joints that will have a length that is between about 10 feet (3.0 meters) and 50 feet (15.2 meters). The pipe joints are typically threadedly connected end-to-end to form the main body section 302 according to length 316.

The packer assembly 300 also includes opposing mechanically-set packers 304. The mechanically-set packers 304 are shown schematically, and are generally in accordance with mechanically-set packer elements 212 and 214 of FIG. 2. The packers 304 preferably include cup-type elastomeric elements that are less than 1 foot (0.3 meters) in length. As described further below, the packers 304 have alternate flow channels that uniquely allow the packers 304 to be set before a gravel slurry is circulated into the wellbore.

A short spacing 308 is provided between the mechanically-set packers 304. The spacing is seen at 308. When the packers 304 are mirror-images of one another, the cup-type elements are able to resist fluid pressure from either above or below the packer assembly.

The packer assembly 300 also includes a plurality of shunt tubes. The shunt tubes are seen in phantom at 318. The shunt tubes 318 may also be referred to as transport tubes or jumper tubes. The shunt tubes 318 are blank sections of pipe having a length that extends along the length 316 of the mechanically-set packers 304 and the spacing 308. The shunt tubes 318 on the packer assembly 300 are configured to couple to and form a seal with shunt tubes on connected sand screens as discussed further below.

The shunt tubes 318 provide an alternate flowpath through the mechanically-set packers 304 and the intermediate spacing 308. This enables the shunt tubes 318 to transport a carrier fluid along with gravel to different intervals 112, 114 and 116 of the open-hole portion 120 of the wellbore 100.

The packer assembly 300 also includes connection members. As exemplified in the illustrations, these connection members may represent traditional threaded couplings. A neck section 306 may be provided at a first end of the packer assembly 300. The neck section 306 has external threads for connecting with a threaded section 310 at an opposing end, such as a coupling box of a sand screen or other pipe or tubular member.

The neck section 306 and the threaded section 310 may be made of steel or steel alloys. The neck section 306 and the threaded section 310 are each configured to be a specific length 314, such as 4 inches (10.2 cm) to 4 feet (1.2 meters) (or other suitable distance). The neck section 306 and the threaded section 310 also have specific inner and outer diameters. The neck section 306 has external threads 307, while the threaded section 310 has internal threads 311. These threads 307 and 311 may be utilized to form a seal between the packer assembly 300 and sand control devices or other pipe segments.

Figure 3B:
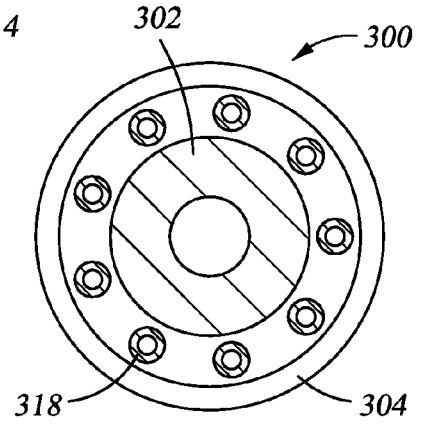
FIG. 3B is a cross-sectional view of the packer assembly of FIG. 3A, taken across lines 3B-3B of FIG. 3A. Shunt tubes are seen within the packer assembly.

A cross-sectional view of the packer assembly 300 is shown in FIG. 3B. FIG. 3B is taken along the line 3B-3B of FIG. 3A. Various shunt tubes 318 are placed radially and equidistantly around the base pipe 302. A central bore 305 is shown within the base pipe 302. The central bore 305 receives production fluids during production operations and conveys them to the production tubing 130.

Figure 4A:
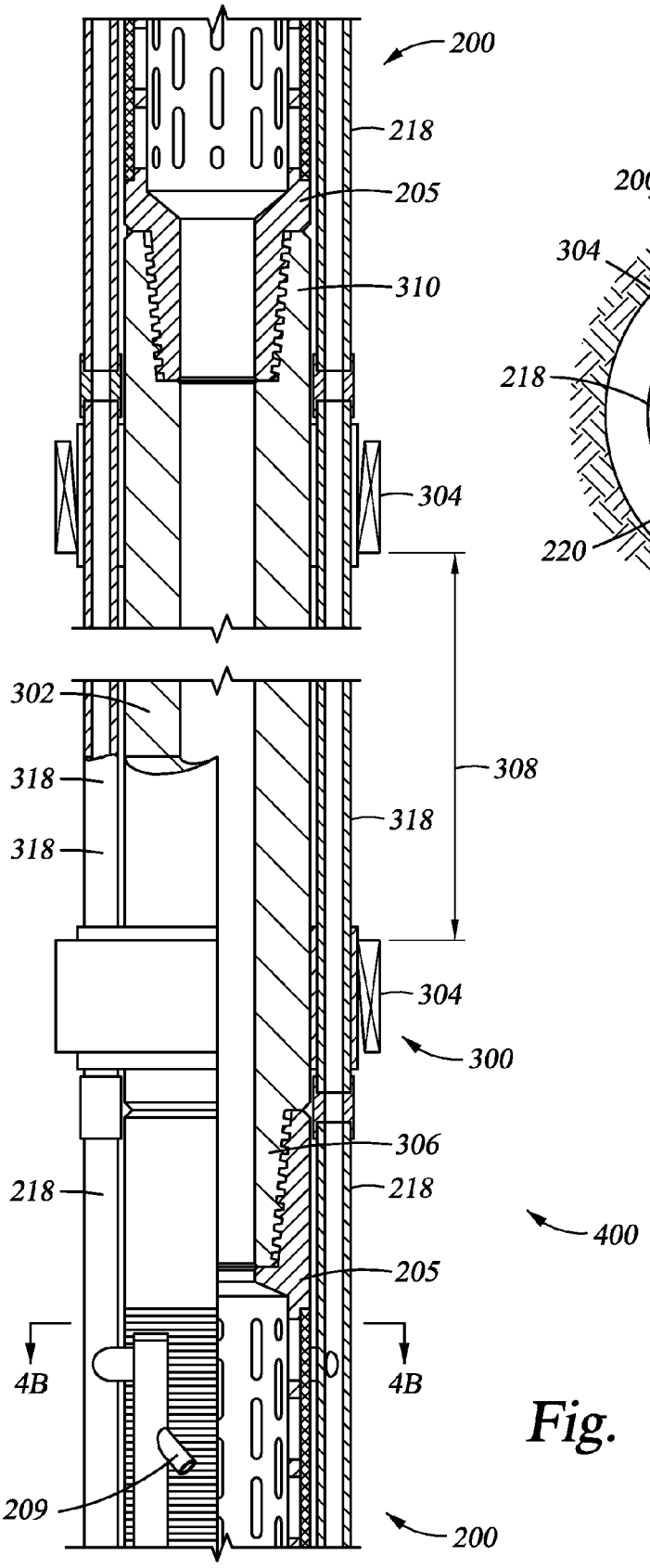
FIG. 4A is a cross-sectional side view of the packer assembly of FIG. 3A. Here, sand control devices, or sand screens, have been placed at opposing ends of the packer assembly. The sand control devices utilize external shunt tubes.

FIG. 4A presents a cross-sectional side view of a zonal isolation apparatus 400, in one embodiment. The zonal isolation apparatus 400 includes the packer assembly 300 from FIG. 3A. In addition, sand control devices 200 have been connected at opposing ends to the neck section 306 and the notched section 310, respectively. Shunt tubes 318 from the packer assembly 300 are seen connected to shunt tubes 218 on the sand control devices 200. The shunt tubes 218 represent packing tubes that allow the flow of gravel slurry between a wellbore annulus and the tubes 218. The shunt tubes 218 on the sand control devices 200 optionally include valves 209 to control the flow of gravel slurry such as to packing tubes (not shown).

Figure 4B:
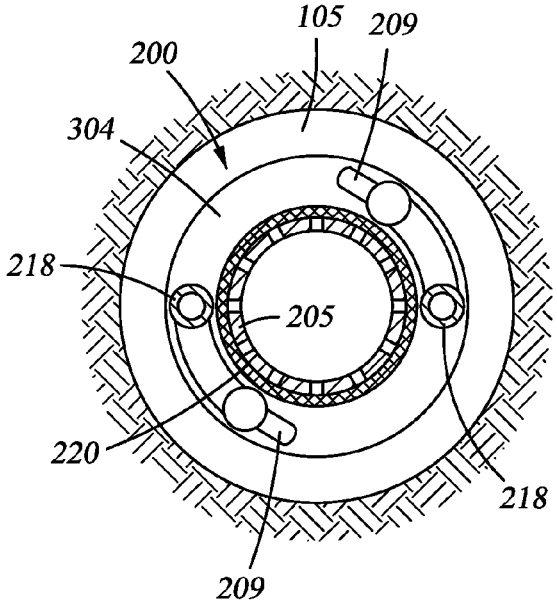
FIG. 4B provides a cross-sectional view of the packer assembly of FIG. 4A, taken across lines 4B-4B of FIG. 4A. Shunt tubes are seen outside of the sand screen to provide an alternative flowpath for a particulate slurry.

FIG. 4B provides a cross-sectional side view of the zonal isolation apparatus 400. FIG. 4B is taken along the line 4B-4B of FIG. 4A. This is cut through one of the sand screens 200. In FIG. 4B, the slotted or perforated base pipe 205 is seen. This is in accordance with base pipe 205 of FIGS. 1 and 2. The central bore 105 is shown within the base pipe 205 for receiving production fluids during production operations.

An outer mesh 220 is disposed immediately around the base pipe 205. The outer mesh 220 preferably comprises a wire mesh or wires helically wrapped around the base pipe 205, and serves as a screen. In addition, shunt tubes 218 are placed radially and equidistantly around the outer mesh 205. This means that the sand control devices 200 provide an external embodiment for the shunt tubes 218 (or alternate flow channels).

The configuration of the shunt tubes 218 is preferably concentric. This is seen in the cross-sectional view of FIG. 3B. However, the shunt tubes 218 may be eccentrically designed. For example, FIG. 2B in U.S. Pat. No. 7,661,476 presents a "Prior Art" arrangement for a sand control device wherein packing tubes 208A and transport tubes 208*b* are placed external to the base pipe 202 and surrounding filter medium 204.

In the arrangement of FIGS. 4A and 4B, the shunt tubes 218 are external to the filter medium, or outer mesh 220. The configuration of the sand control device 200 may be modified. In this respect, the shunt tubes 218 may be moved internal to the filter medium 220.

Figure 5A:
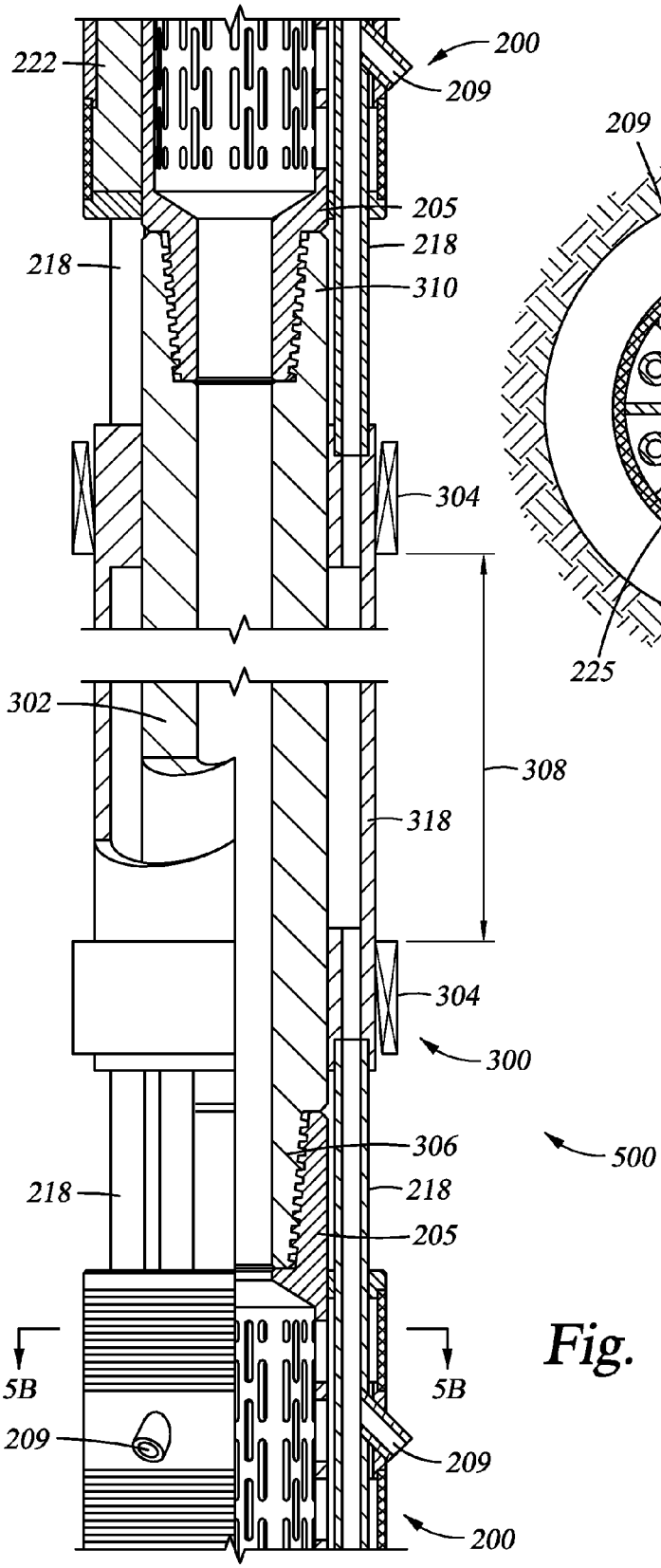
FIG. 5A is another cross-sectional side view of the packer assembly of FIG. 3A. Here, sand control devices, or sand screens, have again been placed at opposing ends of the packer assembly. However, the sand control devices utilize internal shunt tubes.

FIG. 5A presents a cross-sectional side view of a zonal isolation apparatus 500, in an alternate embodiment. In this embodiment, sand control devices 200 are again connected at opposing ends to the neck section 306 and the notched section 310, respectively, of the packer assembly 300. In addition, shunt tubes 318 on the packer assembly 300 are seen connected to shunt tubes 218 on the sand control assembly 200. However, in FIG. 5A, the sand control assembly 200 utilizes internal shunt tubes 218, meaning that the shunt tubes 218 are disposed between the base pipe 205 and the surrounding screen 220.

Figure 5B:
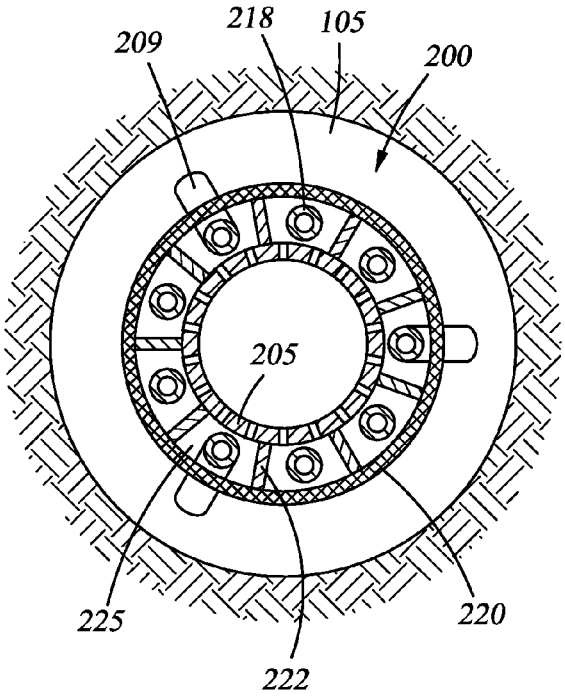
FIG. 5B provides a cross-sectional view of the packer assembly of FIG. 5A, taken across lines 5B-5B of FIG. 5A. Shunt tubes are seen within the sand screen to provide an alternative flowpath for a particulate slurry.

FIG. 5B provides a cross-sectional side view of the zonal isolation apparatus 500. FIG. 5B is taken along the line B-B of FIG. 5A. This is cut through one of the sand screens 200. In FIG. 5B, the slotted or perforated base pipe 205 is again seen. This is in accordance with base pipe 205 of FIGS. 1 and 2. The central bore 105 is shown within the base pipe 205 for receiving production fluids during production operations.

Shunt tubes 218 are placed radially and equidistantly around the base pipe 205. The shunt tubes 218 reside immediately around the base pipe 205, and within a surrounding filter medium 220. This means that the sand control devices 200 of FIGS. 5A and 5B provide an internal embodiment for the shunt tubes 218.

An annular region 225 is created between the base pipe 205 and the surrounding outer mesh or filter medium 220. The annular region 225 accommodates the inflow of production fluids in a wellbore. The outer wire wrap 220 is supported by a plurality of radially extending support ribs 222. The ribs 222 extend through the annular region 225.

FIGS. 4A and 5A present arrangements for connecting sand control joints to a packer assembly. Shunt tubes 318 (or alternate flow channels) within the packers fluidly connect to shunt tubes 218 along the sand screens 200. However, the zonal isolation apparatus arrangements 400, 500 of FIGS. 4A-4B and 5A-5B are merely illustrative. In an alternative arrangement, a manifolding system may be used for providing fluid communication between the shunt tubes 218 and the shunt tubes 318.

Figure 3C:
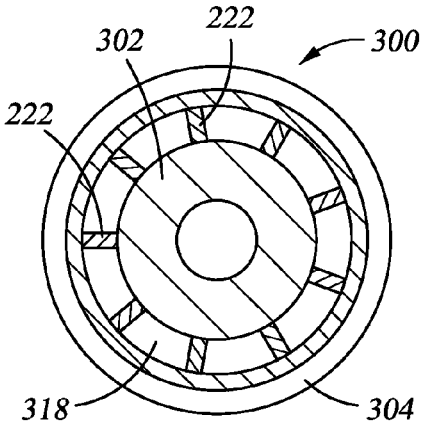
FIG. 3C is a cross-sectional view of the packer assembly of FIG. 3A, in an alternate embodiment. In lieu of shunt tubes, transport tubes are seen manifolded around the base pipe.

FIG. 3C is a cross-sectional view of the packer assembly 300 of FIG. 3A, in an alternate embodiment. In this arrangement, the shunt tubes 218 are manifolded around the base pipe 302. A support ring 315 is provided around the shunt tubes 318. It is again understood that the present apparatus and methods are not confined by the particular design and arrangement of shunt tubes 318 so long as slurry bypass is provided for the packer assembly 210. However, it is preferred that a concentric arrangement be employed.

It should also be noted that the coupling mechanism for the sand control devices 200 with the packer assembly 300 may include a sealing mechanism (not shown). The sealing mechanism prevents leaking of the slurry that is in the alternate flowpath formed by the shunt tubes. Examples of such sealing mechanisms are described in U.S. Pat. No. 6,464,261; Intl. Pat. Application No. WO 2004/094769; Intl. Pat. Application No. WO 2005/031105; U.S. Pat. Publ. No. 2004/0140089; U.S. Pat. Publ. No. 2005/0028977; U.S. Pat. Publ. No. 2005/0061501; and U.S. Pat. Publ. No. 2005/0082060.

As noted, the packer assembly 300 includes a pair of mechanically-set packers 304. When using the packer assembly 300, the packers 304 are beneficially set before the slurry is injected and the gravel pack is formed. This requires a unique packer arrangement wherein shunt tubes are provided for an alternate flow channel.

Figure 6A:
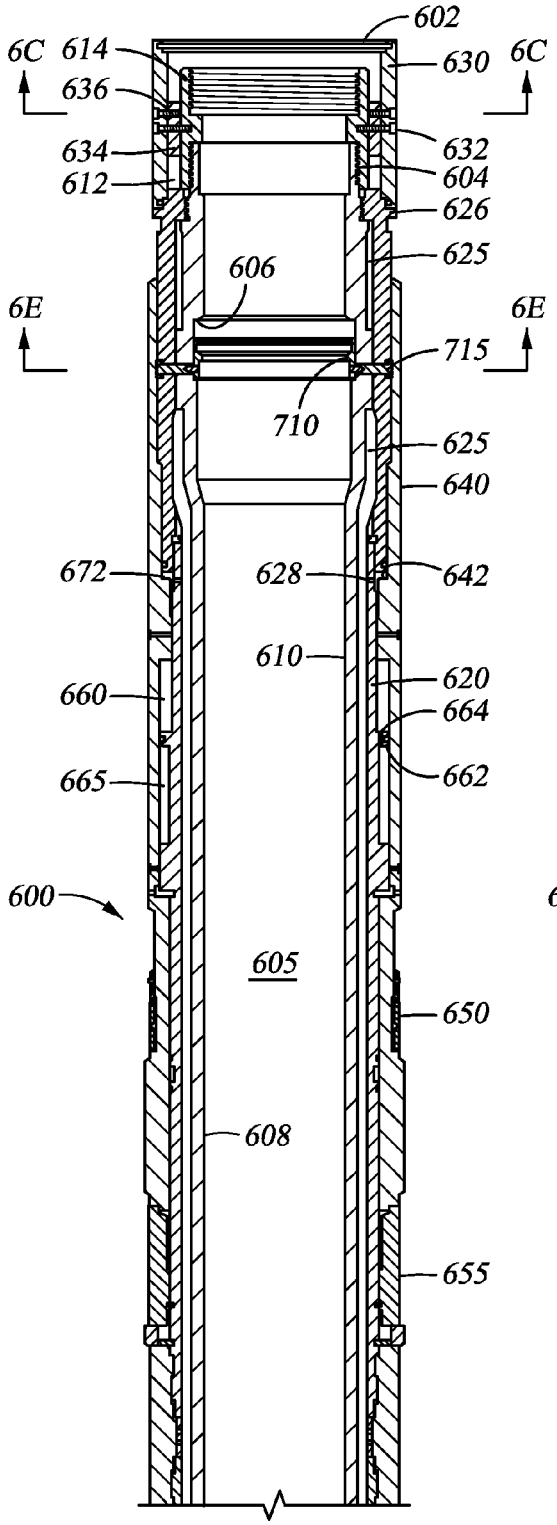
FIG. 6A is a cross-sectional side view of one of the mechanically-set packers of FIG. 3A. The mechanically-set packer is in its run-in position.
Figure 6B:
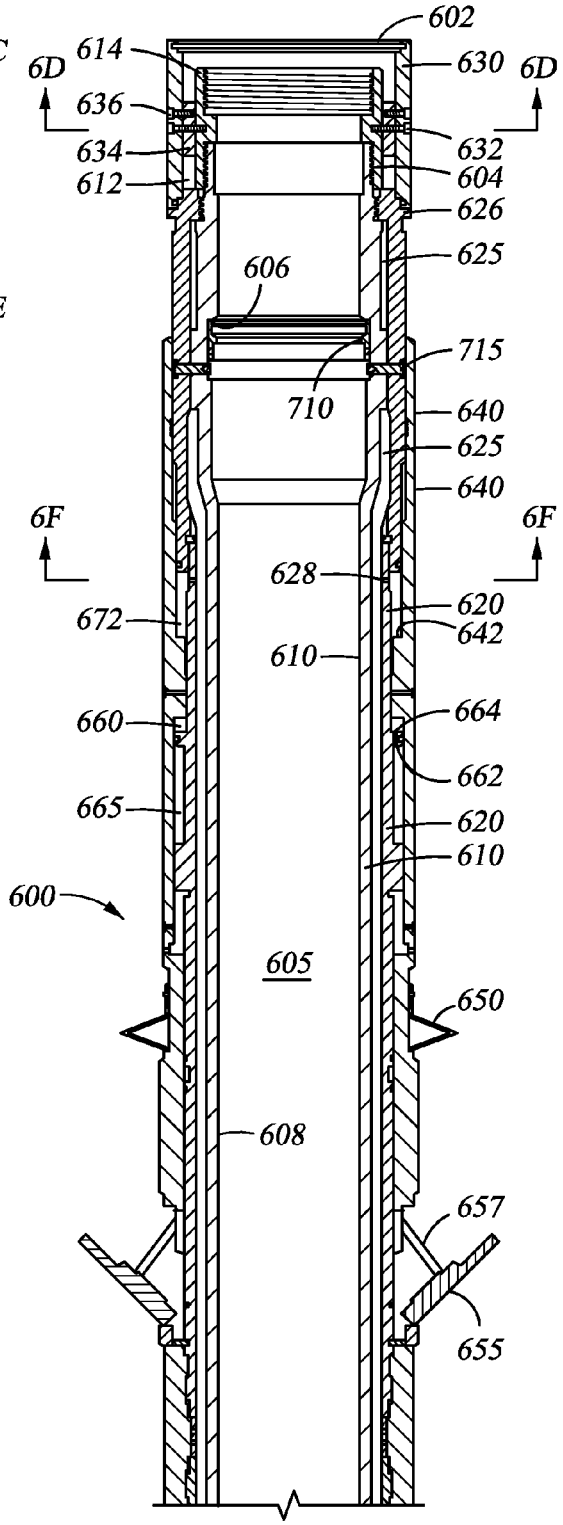
FIG. 6B is a cross-sectional side view of the mechanically-set packer of FIG. 3A. Here, the mechanically-set packer element is in its set position.

The packers 304 of FIG. 3A are shown schematically. However, FIGS. 6A and 6B provide more detailed views of a mechanically-set packer 600 that may be used in the packer assembly of FIG. 3A, in one embodiment. The views of FIGS. 6A and 6B provide cross-sectional side views. In FIG. 6A, the packer 600 is in its run-in position, while in FIG. 6B the packer 600 is in its set position.

The packer 600 first includes an inner mandrel 610. The inner mandrel 610 defines an elongated tubular body forming a central bore 605. The central bore 605 provides a primary flow path of production fluids through the packer 600. After installation and commencement of production, the central bore 605 transports production fluids to the bore 105 of the sand screens 200 (seen in FIGS. 4A and 4B) and the production tubing 130 (seen in FIGS. 1 and 2).

The packer 600 also includes a first end 602. Threads 604 are placed along the inner mandrel 610 at the first end 602. The illustrative threads 604 are external threads. A box connector 614 having internal threads at both ends is connected or threaded on threads 604 at the first end 602. The first end 602 of inner mandrel 610 with the box connector 614 is called the box end. The second end (not shown) of the inner mandrel 610 has external threads and is called the pin end. The pin end (not shown) of the inner mandrel 610 allows the packer 600 to be connected to the box end of a sand screen or other tubular body such as a stand-alone screen, a sensing module, a production tubing, or a blank pipe.

The box connector 614 at the box end 602 allows the packer 600 to be connected to the pin end of a sand screen or other tubular body such as a stand-alone screen, a sensing module, a production tubing, or a blank pipe.

The inner mandrel 610 extends along the length of the packer 600. The inner mandrel 610 may be composed of multiple connected segments, or joints. The inner mandrel 610 has a slightly smaller inner diameter near the first end 602. This is due to a setting shoulder 606 machined into the inner mandrel. As will be explained more fully below, the setting shoulder 606 catches a release sleeve 710 in response to mechanical force applied by a setting tool.

The packer 600 also includes a piston mandrel 620. The piston mandrel 620 extends generally from the first end 602 of the packer 600. The piston mandrel 620 may be composed of multiple connected segments, or joints. The piston mandrel 620 defines an elongated tubular body that resides circumferentially around and substantially concentric to the inner mandrel 610. An annulus 625 is formed between the inner mandrel 610 and the surrounding piston mandrel 620. The annulus 625 beneficially provides a secondary flow path or alternate flow channels for fluids.

In the arrangement of FIGS. 6A and 6B, the alternate flow channels defined by the annulus 625 are external to the inner mandrel 610. However, the packer could be reconfigured such that the alternate flow channels are within the bore 605 of the inner mandrel 610. In either instance, the alternate flow channels are "along" the inner mandrel 610.

The annulus 625 is in fluid communication with the secondary flow path of another downhole tool (not shown in FIGS. 6A and 6B). Such a separate tool may be, for example, the sand screens 200 of FIGS. 4A and 5A, or a blank pipe, or other tubular body. The tubular body may or may not have alternate flow channels.

The packer 600 also includes a coupling 630. The coupling 630 is connected and sealed (e.g., via elastomeric "o" rings) to the piston mandrel 620 at the first end 602. The coupling 630 is then threaded and pinned to the box connector 614, which is threadedly connected to the inner mandrel 610 to prevent relative rotational movement between the inner mandrel 610 and the coupling 630. A first torque bolt is shown at 632 for pinning the coupling to the box connector 614.

In one aspect, a NACA (National Advisory Committee for Aeronautics) key 634 is also employed. The NACA key 634 is placed internal to the coupling 630, and external to a threaded box connector 614. A first torque bolt is provided at 632, connecting the coupling 630 to the NACA key 634 and then to the box connector 614. A second torque bolt is provided at 636 connecting the coupling 630 to the NACA key 634. NACA-shaped keys can (a) fasten the coupling 630 to the inner mandrel 610 via box connector 614, (b) prevent the coupling 630 from rotating around the inner mandrel 610, and (c) streamline the flow of slurry along the annulus 612 to reduce friction.

Within the packer 600, the annulus 625 around the inner mandrel 610 is isolated from the main bore 605. In addition, the annulus 625 is isolated from a surrounding wellbore annulus (not shown). The annulus 625 enables the transfer of gravel slurry from alternative flow channels (such as shunt tubes 218) through the packer 600. Thus, the annulus 625 becomes the alternative flow channel(s) for the packer 600.

In operation, an annular space 612 resides at the first end 602 of the packer 600. The annular space 612 is disposed between the box connector 614 and the coupling 630. The annular space 612 receives slurry from alternate flow channels of a connected tubular body, and delivers the slurry to the annulus 625. The tubular body may be, for example, an adjacent sand screen, a blank pipe, or a zonal isolation device.

The packer 600 also includes a load shoulder 626. The load shoulder 626 is placed near the end of the piston mandrel 620 where the coupling 630 is connected and sealed. A solid section at the end of the piston mandrel 620 has an inner diameter and an outer diameter. The load shoulder 626 is placed along the outer diameter. The inner diameter has threads and is threadedly connected to the inner mandrel 610. At least one alternate flow channel is formed between the inner and outer diameters to connect flow between the annular space 612 and the annulus 625.

The load shoulder 626 provides a load-bearing point. During rig operations, a load collar or harness (not shown) is placed around the load shoulder 626 to allow the packer 600 to be picked up and supported with conventional elevators. The load shoulder 626 is then temporarily used to support the weight of the packer 600 (and any connected completion devices such as sand screen joints already run into the well) when placed in the rotary floor of a rig. The load may then be transferred from the load shoulder 626 to a pipe thread connector such as box connector 614, then to the inner mandrel 610 or base pipe 205, which is pipe threaded to the box connector 614.

The packer 600 also includes a piston housing 640. The piston housing 640 resides around and is substantially concentric to the piston mandrel 620. The packer 600 is configured to cause the piston housing 640 to move axially along and relative to the piston mandrel 620. Specifically, the piston housing 640 is driven by the downhole hydrostatic pressure. The piston housing 640 may be composed of multiple connected segments, or joints.

The piston housing 640 is held in place along the piston mandrel 620 during run-in. The piston housing 640 is secured using a release sleeve 710 and release key 715. The release sleeve 710 and release key 715 prevent relative translational movement between the piston housing 640 and the piston mandrel 620. The release key 715 penetrates through both the piston mandrel 620 and the inner mandrel 610.

Figure 7A:
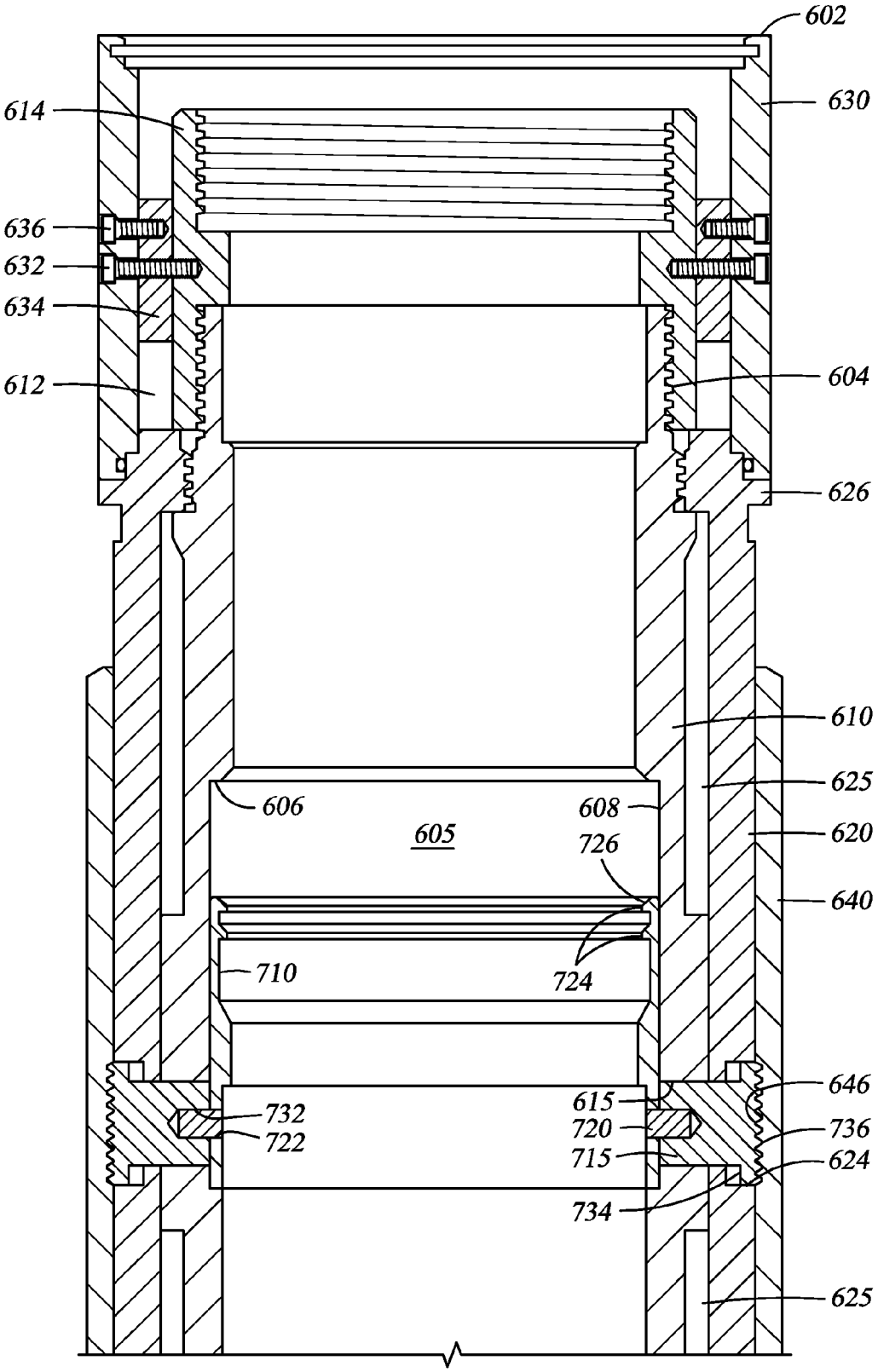
FIG. 7A is an enlarged view of the release key of FIG. 6A. The release key is in its run-in position along the inner mandrel. The shear pin has not yet been sheared.
Figure 7B:
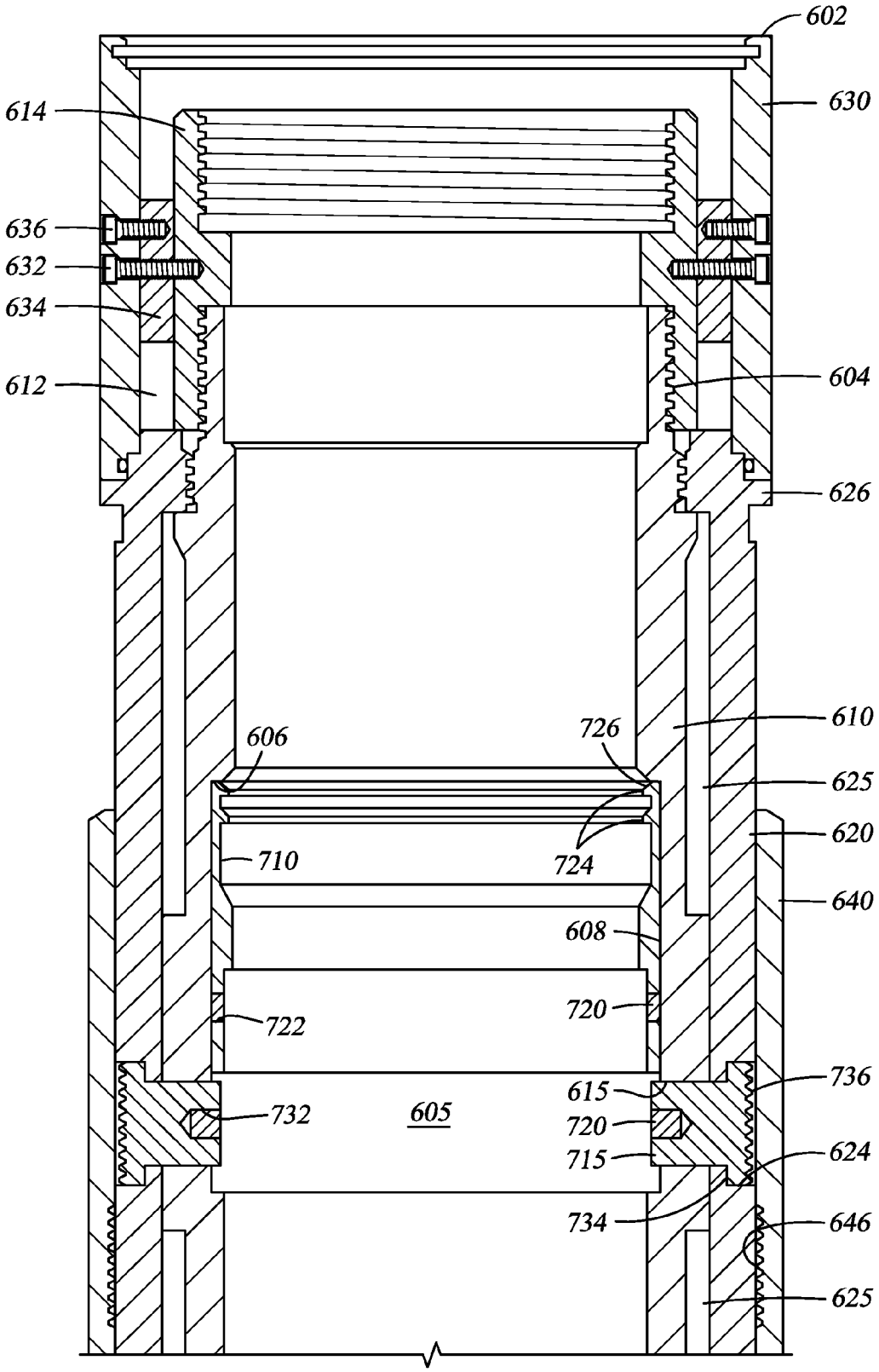
FIG. 7B is an enlarged view of the release key of FIG. 6B. The shear pin has been sheared, and the release key has dropped away from the inner mandrel.

FIGS. 7A and 7B provide enlarged views of the release sleeve 710 and the release key 715 for the packer 600. The release sleeve 710 and the release key 715 are held in place by a shear pin 720. In FIG. 7A, the shear pin 720 has not been sheared, and the release sleeve 710 and the release key 715 are held in place along the inner mandrel 610. However, in FIG. 7B the shear pin 720 has been sheared, and the release sleeve 710 has been translated along an inner surface 608 of the inner mandrel 610.

In each of FIGS. 7A and 7B, the inner mandrel 610 and the surrounding piston mandrel 620 are seen. In addition, the piston housing 640 is seen outside of the piston mandrel 620. The three tubular bodies representing the inner mandrel 610, the piston mandrel 620, and the piston housing 640 are secured together against relative translational or rotational movement by four release keys 715. Only one of the release keys 715 is seen in FIG. 7A; however, four separate keys 715 are radially visible in the cross-sectional view of FIG. 6E, described below.

The release key 715 resides within a keyhole 615. The keyhole 615 extends through the inner mandrel 610 and the piston mandrel 620. The release key 715 includes a shoulder 734. The shoulder 734 resides within a shoulder recess 624 in the piston mandrel 620. The shoulder recess 624 is large enough to permit the shoulder 734 to move radially inwardly. However, such play is restricted in FIG. 7A by the presence of the release sleeve 710.

It is noted that the annulus 625 between the inner mandrel 610 and the piston mandrel 620 is not seen in FIG. 7A or 7B. This is because the annulus 625 does not extend through this cross-section, or is very small. Instead, the annulus 625 employs separate radially-spaced channels that preserve the support for the release keys 715, as seen best in FIG. 6E. Stated another way, the large channels making up the annulus 625 are located away from the material of the inner mandrel 610 that surrounds the keyholes 615.

At each release key location, a keyhole 615 is machined through the inner mandrel 610. The keyholes 615 are drilled to accommodate the respective release keys 715. If there are four release keys 715, there will be four discrete bumps spaced circumferentially to significantly reduce the annulus 625. The remaining area of the annulus 625 between adjacent bumps allows flow in the alternate flow channel 625 to bypass the release key 715.

Bumps may be machined as part of the body of the inner mandrel 610. More specifically, material making up the inner mandrel 610 may be machined to form the bumps. Alternatively, bumps may be machined as a separate, short release mandrel (not shown), which is then threaded to the inner mandrel 610. Alternatively still, the bumps may be a separate spacer secured between the inner mandrel 610 and the piston mandrel 620 by welding or other means.

It is also noted here that in FIG. 6A, the piston mandrel 620 is shown as an integral body. However, the portion of the piston mandrel 620 where the keyholes 615 are located may be a separate, short release housing. This separate housing is then connected to the main piston mandrel 620.

Each release key 715 has an opening 732. Similarly, the release sleeve 710 has an opening 722. The opening 732 in the release key 715 and the opening 722 in the release sleeve 710 are sized and configured to receive a shear pin. The shear pin is seen at 720. In FIG. 7A, the shear pin 720 is held within the openings 732, 722 by the release sleeve 710. However, in FIG. 7B the shear pin 720 has been sheared, and only a small portion of the pin 720 remains visible.

An outer edge of the release key 715 has a ruggled surface, or teeth. The teeth for the release key 715 are shown at 736. The teeth 736 of the release key 715 are angled and configured to mate with a reciprocal ruggled surface within the piston housing 640. The mating ruggled surface (or teeth) for the piston housing 640 are shown at 646. The teeth 646 reside on an inner face of the piston housing 640. When engaged, the teeth 736, 646 prevent movement of the piston housing 640 relative to the piston mandrel 620 or the inner mandrel 610. Preferably, the mating ruggled surface or teeth 646 reside on the inner face of a separate, short outer release sleeve, which is then threaded to the piston housing 640.

Returning now to FIGS. 6A and 6B, the packer 600 includes a centralizing member 650. The centralizing member 650 is actuated by the movement of the piston housing 640. The centralizing member 650 may be, for example, as described in U.S. Patent Publication No. 2011/0042106.

The packer 600 further includes a sealing element 655. As the centralizing member 650 is actuated and centralizes the packer 600 within the surrounding wellbore, the piston housing 640 continues to actuate the sealing element 655 as described in U.S. Patent Publication No. 2009/0308592.

In FIG. 6A, the centralizing member 650 and sealing element 655 are in their run-in position. In FIG. 6B, the centralizing member 650, energy directing member 657, and connected sealing element 655 have been actuated. This means the piston housing 640 has moved along the piston mandrel 620, causing both the centralizing member 650 and the sealing element 655 to engage the surrounding wellbore wall.

An anchor system as described in WO 2010/084353 may be used to prevent the piston housing 640 from going backward. This prevents contraction of the cup-type element 655.

As noted, movement of the piston housing 640 takes place in response to hydrostatic pressure from wellbore fluids, including the gravel slurry. In the run-in position of the packer 600 (shown in FIG. 6A), the piston housing 640 is held in place by the release sleeve 710 and associated piston key 715. This position is shown in FIG. 7A. In order to set the packer 600 (in accordance with FIG. 6B), the release sleeve 710 must be moved out of the way of the release key 715 so that the teeth 736 of the release key 715 are no longer engaged with the teeth 646 of the piston housing 640. This position is shown in FIG. 7B.

To move the release the release sleeve 710, a setting tool is used. An illustrative setting tool is shown at 750 in FIG. 7C. The setting tool 750 defines a short cylindrical body 755. Preferably, the setting tool 750 is run into the wellbore with a washpipe string (not shown). Movement of the washpipe string along the wellbore can be controlled at the surface.

An upper end 752 of the setting tool 750 is made up of several radial collet fingers 760. The collet fingers 760 collapse when subjected to sufficient inward force. In operation, the collet fingers 760 latch into a profile 724 formed along the release sleeve 710. The collet fingers 760 include raised surfaces 762 that mate with or latch into the profile 724 of the release key 710. Upon latching, the setting tool 750 is pulled or raised within the wellbore. The setting tool 750 then pulls the release sleeve 710 with sufficient force to cause the shear pins 720 to shear. Once the shear pins 720 are sheared, the release sleeve 710 is free to translate upward along the inner surface 608 of the inner mandrel 610.

Figure 7C:
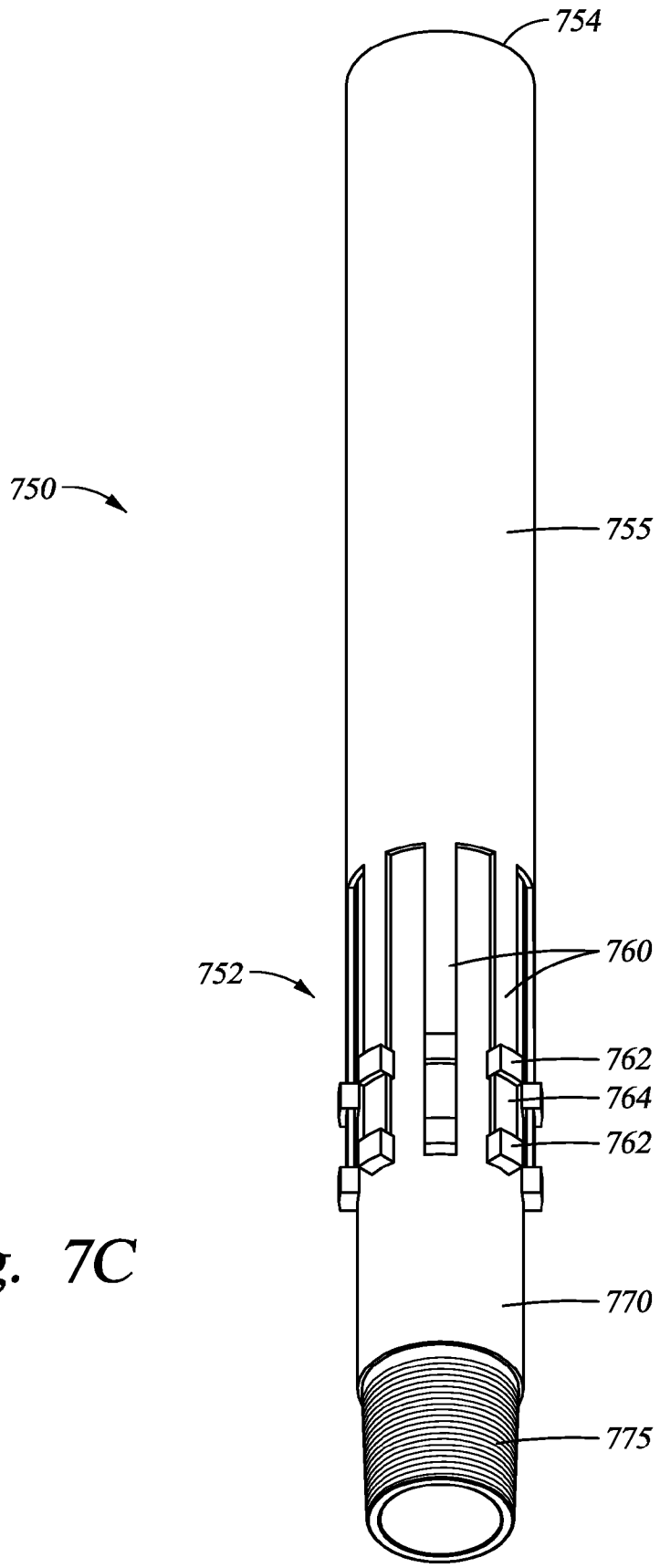
FIG. 7C is a perspective view of a setting tool as may be used to latch onto a release sleeve, and thereby shear a shear pin within the release key.

As noted, the setting tool 750 may be run into the wellbore with a washpipe. The setting tool 750 may simply be a profiled portion of the washpipe body. Preferably, however, the setting tool 750 is a separate tubular body 755 that is threadedly connected to the washpipe. In FIG. 7C, a connection tool is provided at 770. The connection tool 770 includes external threads 775 for connecting to a drill string or other run-in tubular. The connection tool 770 extends into the body 755 of the setting tool 750. The connection tool 770 may extend all the way through the body 755 to connect to the washpipe or other device, or it may connect to internal threads (not seen) within the body 755 of the setting tool 750.

Returning to FIGS. 7A and 7B, the travel of the release sleeve 710 is limited. In this respect, a first or top end 726 of the release sleeve 710 stops against the shoulder 606 along the inner surface 608 of the inner mandrel 610. The length of the release sleeve 710 is short enough to allow the release sleeve 710 to clear the opening 732 in the release key 715. When fully shifted, the release key 715 moves radially inward, pushed by the ruggled profile in the piston housing 640 when hydrostatic pressure is present.

Shearing of the pin 720 and movement of the release sleeve 710 also allows the release key 715 to disengage from the piston housing 640. The shoulder recess 624 is dimensioned to allow the shoulder 734 of the release key 715 to drop or to disengage from the teeth 646 of the piston housing 640 once the release sleeve 710 is cleared. Hydrostatic pressure then acts upon the piston housing 640 to translate it downward relative to the piston mandrel 620.

After the shear pins 720 have been sheared, the piston housing 640 is free to slide along an outer surface of the piston mandrel 620. To accomplish this, hydrostatic pressure from the annulus 625 acts upon a shoulder 642 in the piston housing 640. This is seen best in FIG. 6B. The shoulder 642 serves as a pressure-bearing surface. A fluid port 628 is provided through the piston mandrel 620 to allow fluid to access the shoulder 642. Beneficially, the fluid port 628 allows a pressure higher than hydrostatic pressure to be applied during gravel packing operations. The pressure is applied to the piston housing 640 to ensure that the packer elements 655 engage against the surrounding wellbore.

The packer 600 also includes a metering device. As the piston housing 640 translates along the piston mandrel 620, a metering orifice 664 regulates the rate the piston housing translates along the piston mandrel therefore slowing the movement of the piston housing and regulating the setting speed for the packer 600. To further understand features of the illustrative mechanically-set packer 600, several additional cross-sectional views are provided. These are seen at FIGS. 6C, 6D, 6E, and 6F.

Figure 6C:
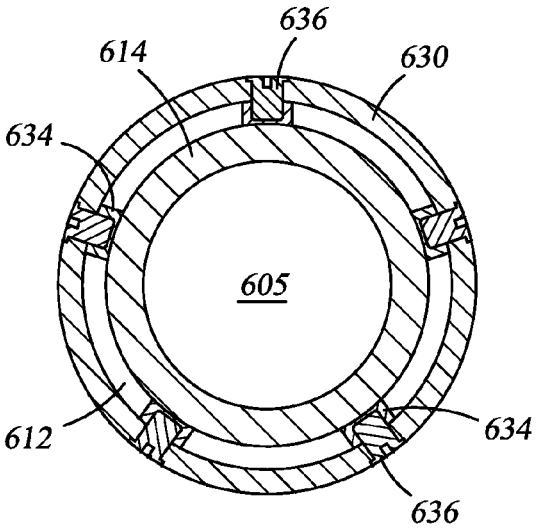
FIG. 6C is a cross-sectional view of the mechanically-set packer of FIG. 6A. The view is taken across line 6C-6C of FIG. 6A.

First, FIG. 6C is a cross-sectional view of the mechanically-set packer of FIG. 6A. The view is taken across line 6C-6C of FIG. 6A. Line 6C-6C is taken through one of the torque bolts 636. The torque bolt 636 connects the coupling 630 to the NACA key 634.

Figure 6D:
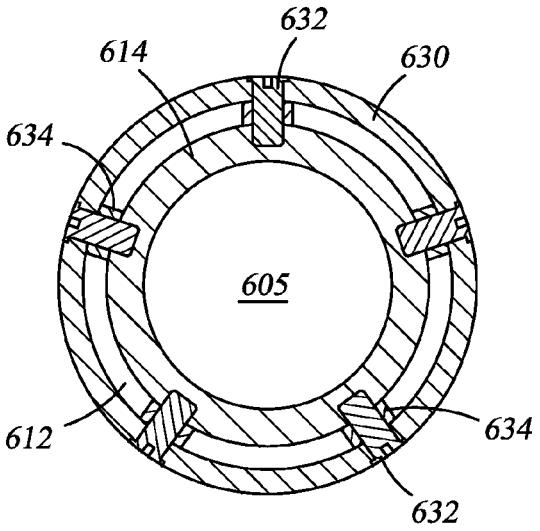
FIG. 6D is a cross-sectional view of the mechanically-set packer of FIG. 6A. The view is taken across line 6D-6D of FIG. 6B.

FIG. 6D is a cross-sectional view of the mechanically-set packer of FIG. 6A. The view is taken across line 6D-6D of FIG. 6B. Line 6D-6D is taken through another of the torque bolts 632. The torque bolt 632 connects the coupling 630 to the box connector 614, which is threaded to the inner mandrel 610.

Figure 6E:
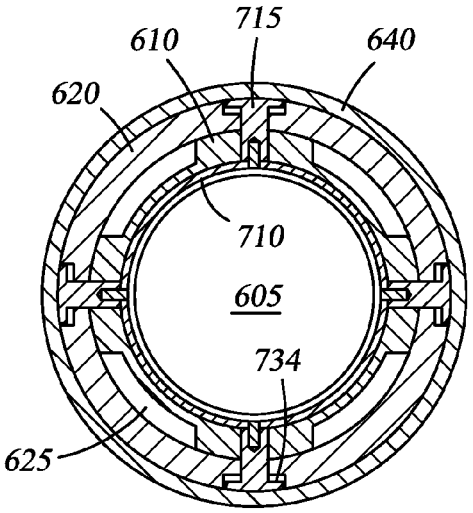
FIG. 6E is a cross-sectional view of the mechanically-set packer of FIG. 6A. The view is taken across line 6E-6E of FIG. 6A.

FIG. 6E is a cross-sectional view of the mechanically-set packer 600 of FIG. 6A. The view is taken across line 6E-6E of FIG. 6A. Line 6E-E is taken through the release key 715. It can be seen that the release key 715 passes through the piston mandrel 620 and into the inner mandrel 610. It is also seen that the alternate flow channel 625 resides between the release keys 715.

Figure 6F:
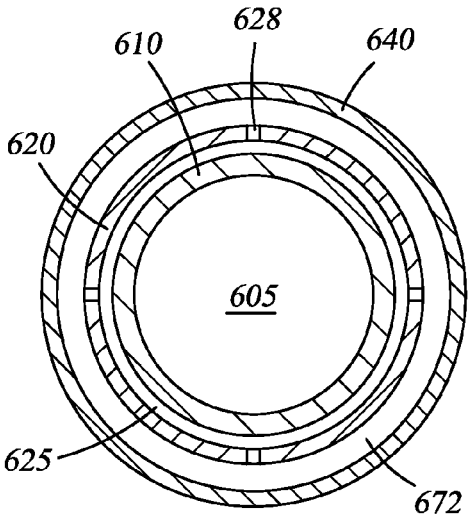
FIG. 6F is a cross-sectional view of the mechanically-set packer of FIG. 6A. The view is taken across line 6F-6F of FIG. 6B.

FIG. 6F is a cross-sectional view of the mechanically-set packer 600 of FIG. 6A. The view is taken across line 6F-6F of FIG. 6B. Line 6F-6F is taken through the fluid ports 628 within the piston mandrel 620. As the fluid moves through the fluid ports 628 and pushes the shoulder 642 of the piston housing 640 away from the ports 628, an annular gap 672 is created and elongated between the piston mandrel 620 and the piston housing 640.

Once the bypass packer 600 is set, gravel packing operations may commence. FIGS. 8A through 8J present stages of a gravel packing procedure, in one embodiment. The gravel packing procedure uses a packer assembly having alternate flow channels. The packer assembly may be in accordance with packer assembly 300 of FIG. 3A. The packer assembly 300 will have mechanically-set packers 304. These mechanically-set packers 304 may be in accordance with packer 600 of FIGS. 6A and 6B.

Figure 8A:
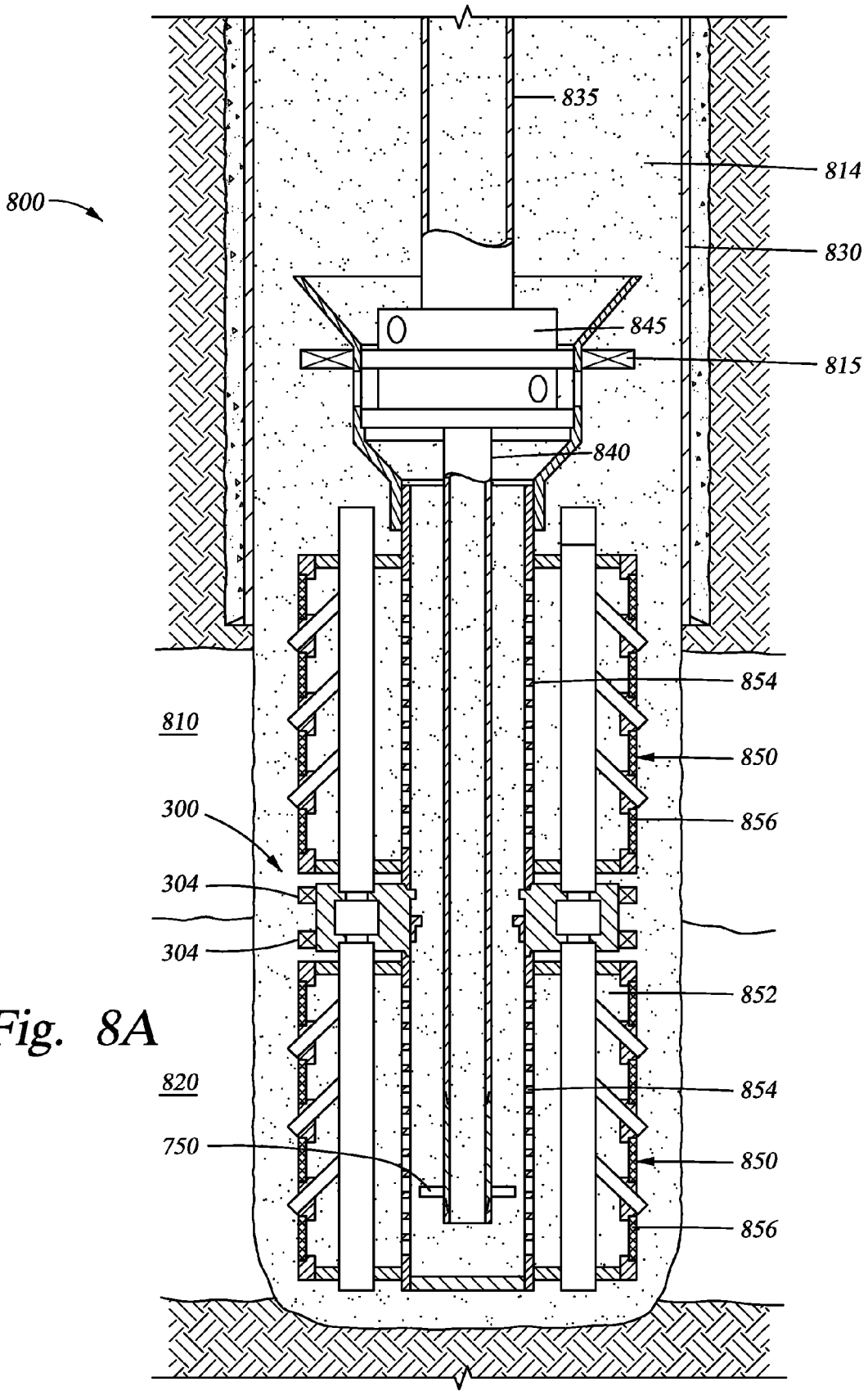
FIGS. 8A through 8J present stages of a gravel packing procedure using one of the packer assemblies of the present invention, in one embodiment. Alternate flowpath channels are provided through the packer elements of the packer assembly and through the sand control devices.

In FIGS. 8A through 8J, sand control devices are utilized with an illustrative gravel packing procedure. In FIG. 8A, a wellbore 800 is shown. The illustrative wellbore 800 is a horizontal, open-hole wellbore. The wellbore 800 includes a wall 805. Two different production intervals are indicated along the horizontal wellbore 800. These are shown at 810 and 820. Two sand control devices 850 have been run into the wellbore 800. Separate sand control devices 850 are provided in each production interval 810, 820. Fluids in the wellbore 800 have been displaced using a clean fluid 814.

Each of the sand control devices 850 is comprised of a base pipe 854 and a surrounding sand screen 856. The base pipe 854 has slots or perforations to allow fluid to flow into the base pipe 854. The sand control devices 850 also each include alternate flow paths. These may be in accordance with shunt tubes 218 from either FIG. 4B or FIG. 5B. Preferably, the shunt tubes are internal shunt tubes disposed between the base pipes 854 and the sand screens 856 in the annular region shown at 852.

The sand control devices 850 are connected via an intermediate packer assembly 300. In the arrangement of FIG. 8A, the packer assembly 300 is installed at the interface between production intervals 810 and 820. More than one packer assembly 300 may be incorporated.

In addition to the sand control devices 850, a washpipe 840 has been lowered into the wellbore 800. The washpipe 840 is run into the wellbore 800 below a crossover tool or a gravel pack service tool (not shown) which is attached to the end of a drill pipe 835 or other working string. The washpipe 840 is an elongated tubular member that extends into the sand screens 850. The washpipe 840 aids in the circulation of the gravel slurry during a gravel packing operation, and is subsequently removed. Attached to the washpipe 840 is a shifting tool, such as the shifting tool 750 presented in FIG. 7C. The shifting tool 750 is positioned below the packer 300.

In FIG. 8A, a crossover tool 845 is placed at the end of the drill pipe 835. The crossover tool 845 is used to direct the injection and circulation of the gravel slurry, as discussed in further detail below.

A separate packer 815 is connected to the crossover tool 845. The packer 815 and connected crossover tool 845 are temporarily positioned within a string of production casing 830. Together, the packer 815, the crossover tool 845, the elongated washpipe 840, the shifting tool 750, and the gravel pack screens 850 are run into the lower end of the wellbore 800. The packer 815 is then set in the production casing 830. The crossover tool 845 is then released from the packer 815 and is free to move as shown in FIG. 8B.

Figure 8B:
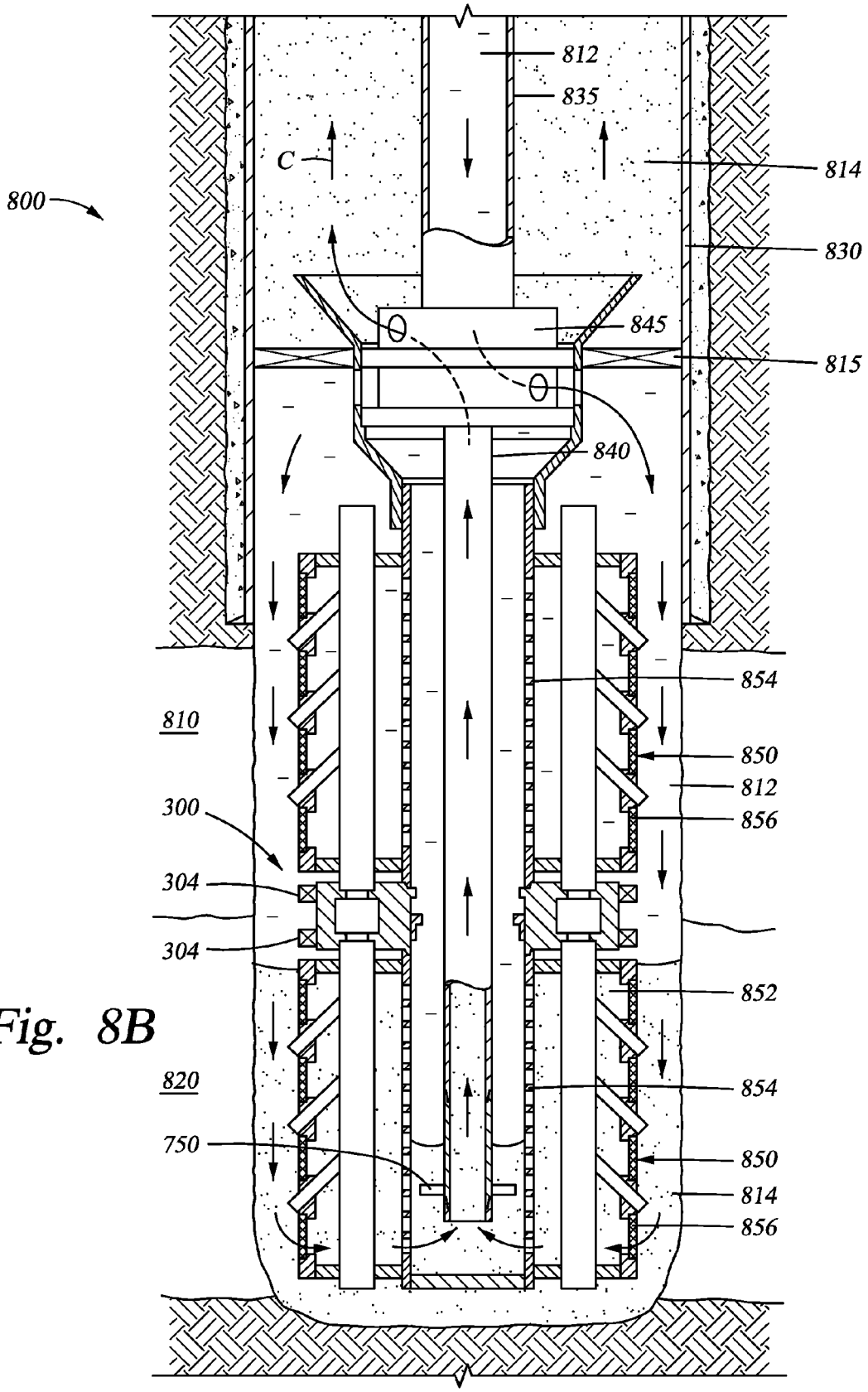

In FIG. 8B, the packer 815 is set in the production casing string 830. This means that the packer 815 is actuated to extend slips and an elastomeric sealing element against the surrounding casing string 830. The packer 815 is set above the intervals 810 and 820, which are to be gravel packed. The packer 815 seals the intervals 810 and 820 from the portions of the wellbore 800 above the packer 815.

After the packer 815 is set, as shown in FIG. 8B, the crossover tool 845 is shifted up into a reverse position. Circulation pressures can be taken in this position. A carrier fluid 812 is pumped down the drill pipe 835 and placed into an annulus between the drill pipe 835 and the surrounding production casing 830 above the packer 815. The carrier fluid is a gravel carrier fluid, which is the liquid component of the gravel packing slurry. The carrier fluid 812 displaces the clean displacement fluid 814 above the packer 815, which may be an oil-based fluid such as the conditioned NAF. The carrier fluid 812 displaces the displacement fluid 814 in the direction indicated by arrows "C."

Figure 8C:
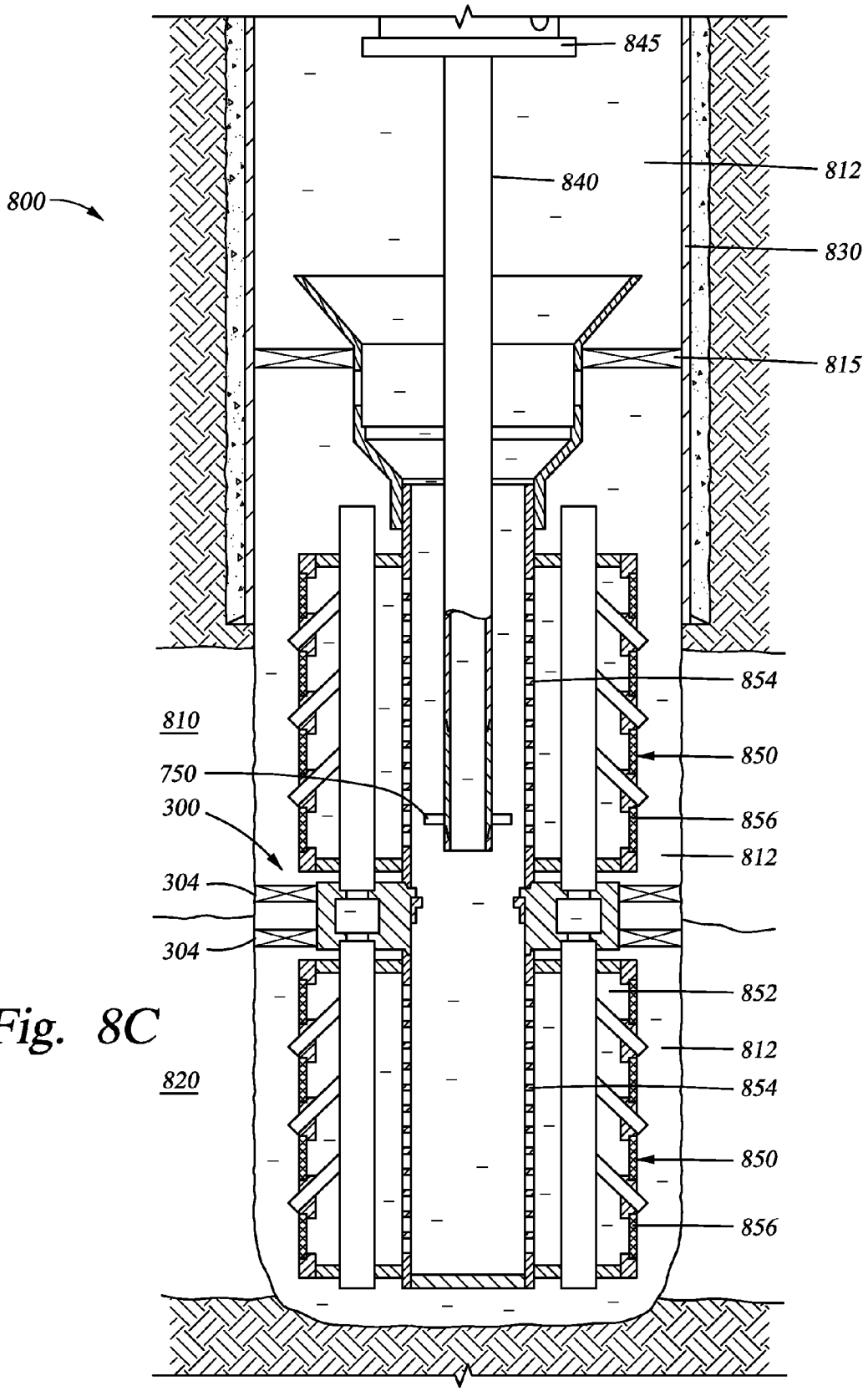

Next, the packers 304 are set, as shown in FIG. 8C. This is done by pulling the shifting tool located below the packer assembly 300 on the washpipe 840 and up past the packer assembly 300. More specifically, the mechanically-set packers 304 of the packer assembly 300 are set. The packers 304 may be, for example, packer 600 of FIGS. 6A and 6B. The packer 600 is used to isolate the annulus formed between the sand screens 856 and the surrounding wall 805 of the wellbore 800. The washpipe 840 is lowered to a reverse position. While in the reverse position, as shown in FIG. 8D, the carrier fluid 812 with gravel may be placed within the drill pipe 835 and utilized to force the clean displacement fluid 814 through the washpipe 840 and up the annulus formed between the drill pipe 835 and production casing 830 above the packer 815, as shown by the arrows "C."

Figure 8D:
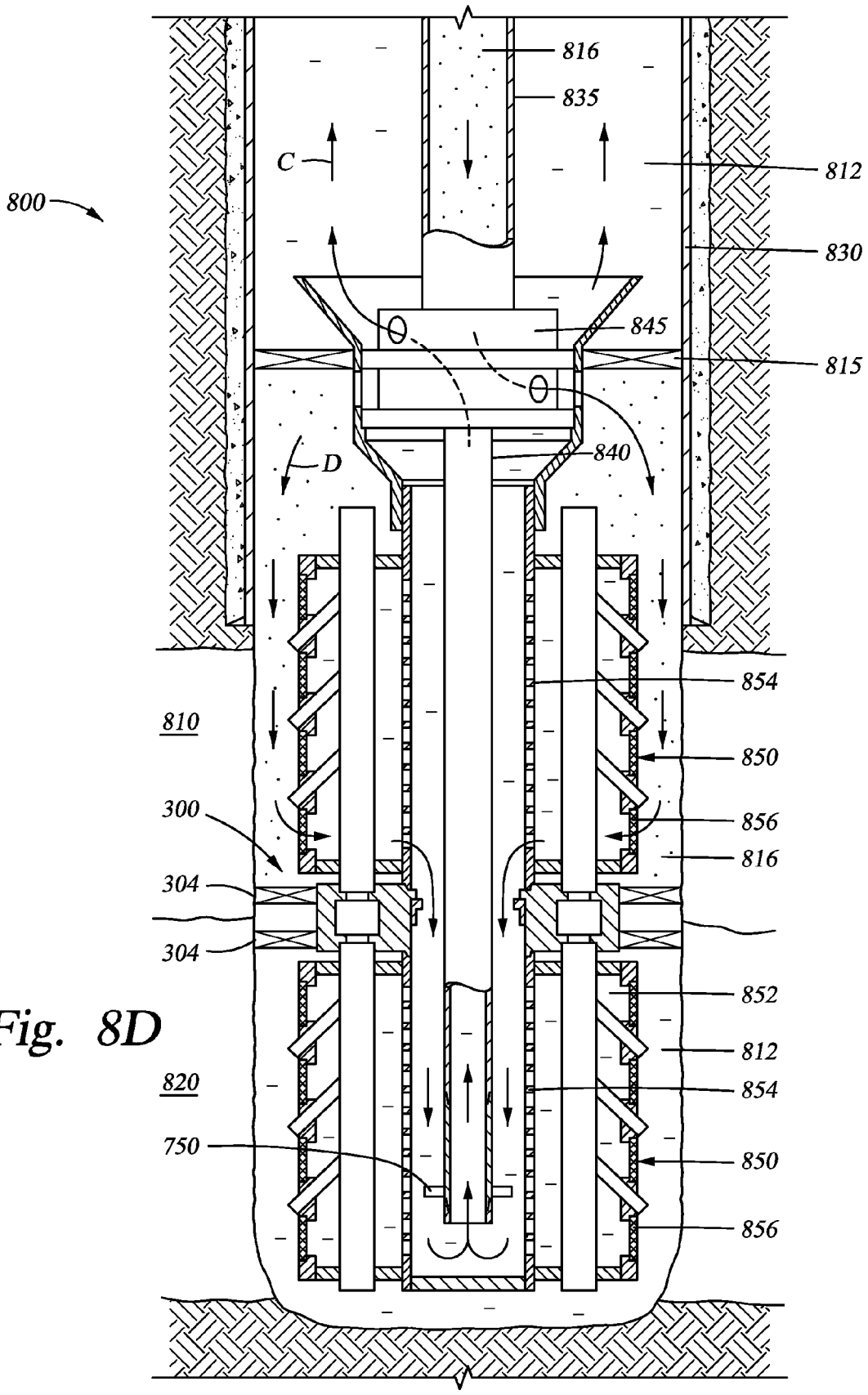
Figure 8E:
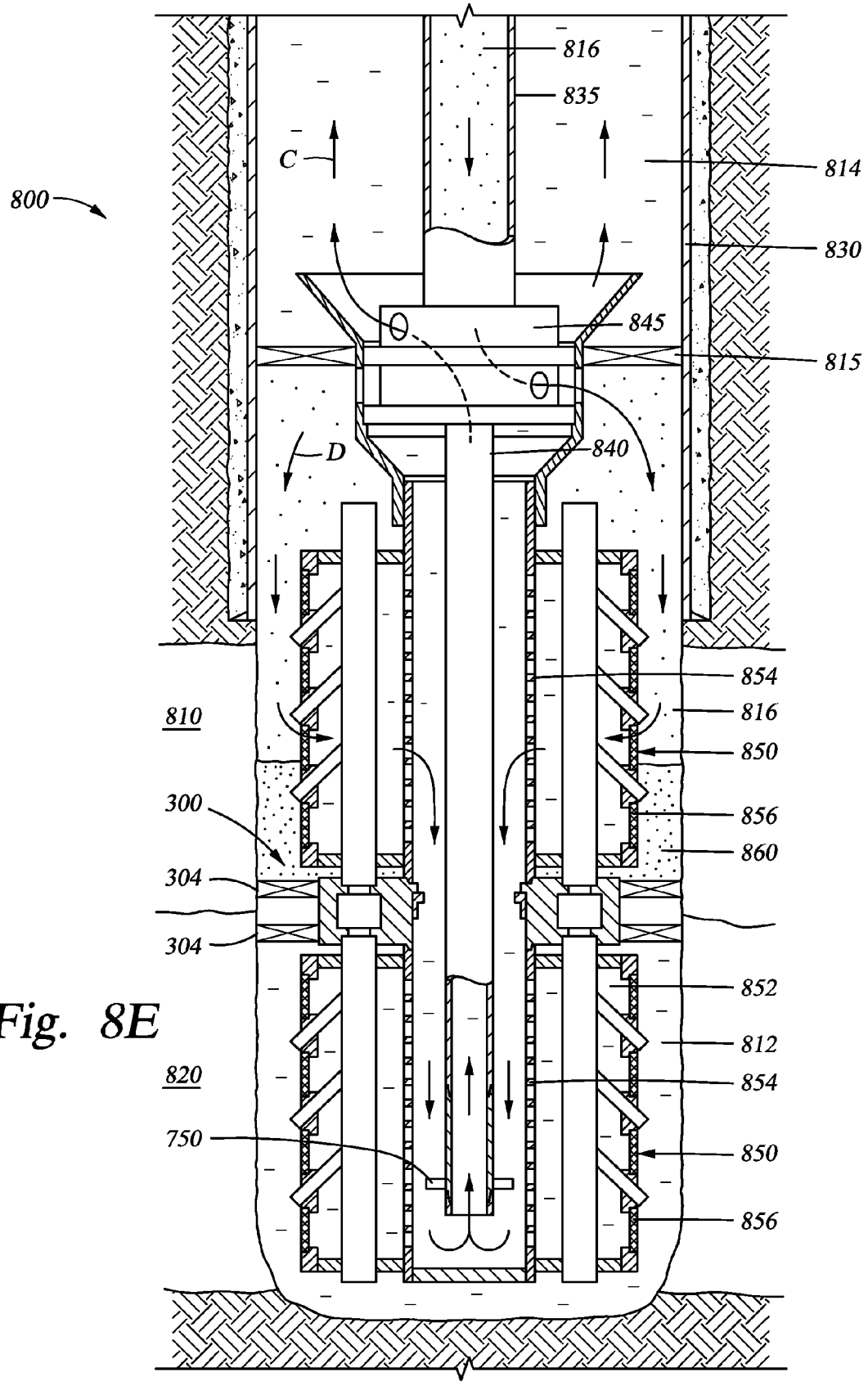
Figure 8F:
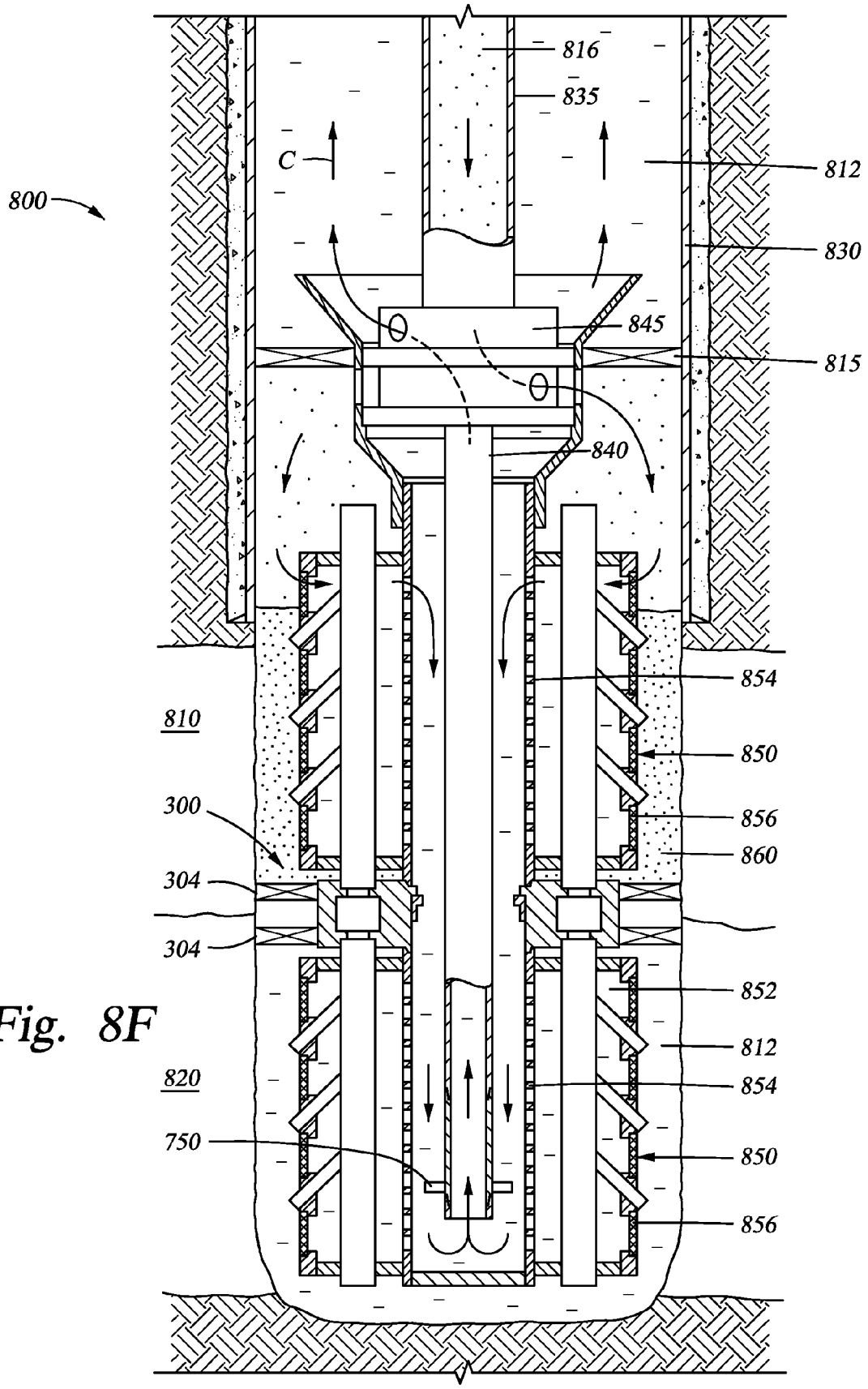

In FIGS. 8D through 8F, the crossover tool 845 may be shifted into the circulating position to gravel pack the first subsurface interval 810. In FIG. 8D, the carrier fluid with gravel 816 begins to create a gravel pack within the production interval 810 above the packer 300 in the annulus between the sand screen 856 and the wall 805 of the open-hole wellbore 800. The fluid flows outside the sand screen 856 and returns through the washpipe 840 as indicated by the arrows "D."

In FIG. 8E, a first gravel pack 860 begins to form above the packer 300. The gravel pack 860 is forming around the sand screen 856 and towards the packer 815. Carrier fluid 812 is circulated below the packer 300 and to the bottom of the wellbore 800. The carrier fluid 812 without gravel flows up the washpipe 840 as indicated by arrows "C."

In FIG. 8F, the gravel packing process continues to form the gravel pack 860 toward the packer 815. The sand screen 856 is now being fully covered by the gravel pack 860 above the packer 300. Carrier fluid 812 continues to be circulated below the packer 300 and to the bottom of the wellbore 800. The carrier fluid 812 sans gravel flows up the washpipe 840 as again indicated by arrows "C."

Once the gravel pack 860 is formed in the first interval 810 and the sand screens above the packer 300 are covered with gravel, the carrier fluid with gravel 816 is forced through the shunt tubes (shown at 318 in FIG. 3B). The carrier fluid with gravel 816 forms the gravel pack 860 in FIGS. 8G through 8J.

Figure 8G:
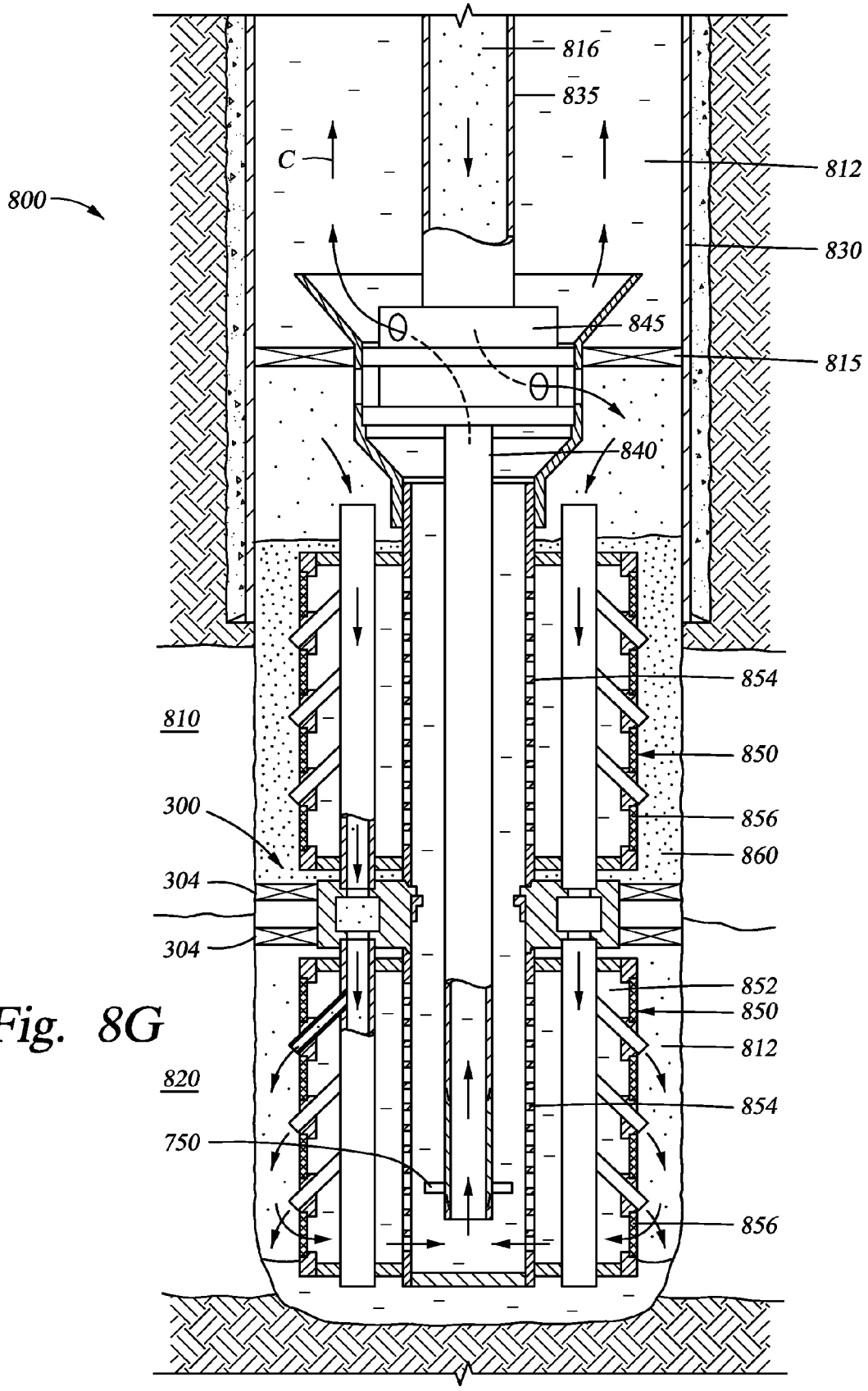

In FIG. 8G, the carrier fluid with gravel 816 now flows within the production interval 820 below the packer 300. The carrier fluid 816 flows through the shunt tubes and packer 300, and then outside the sand screen 856. The carrier fluid 816 then flows in the annulus between the sand screen 856 and the wall 805 of the wellbore 800, and returns through the washpipe 840. The flow of carrier fluid with gravel 816 is indicated by arrows "D," while the flow of carrier fluid in the washpipe 840 without the gravel is indicated at 812, shown by arrows "C."

It is noted here that slurry only flows through the bypass channels along the packer sections. After that, slurry will go into the alternate flow channels in the next, adjacent screen joint. Alternate flow channels have both transport and packing tubes manifolded together at each end of a screen joint. Packing tubes are provided along the sand screen joints. The packing tubes represent side nozzles that allow slurry to fill any voids in the annulus. Transport tubes will take the slurry further downstream.

Figure 8H:
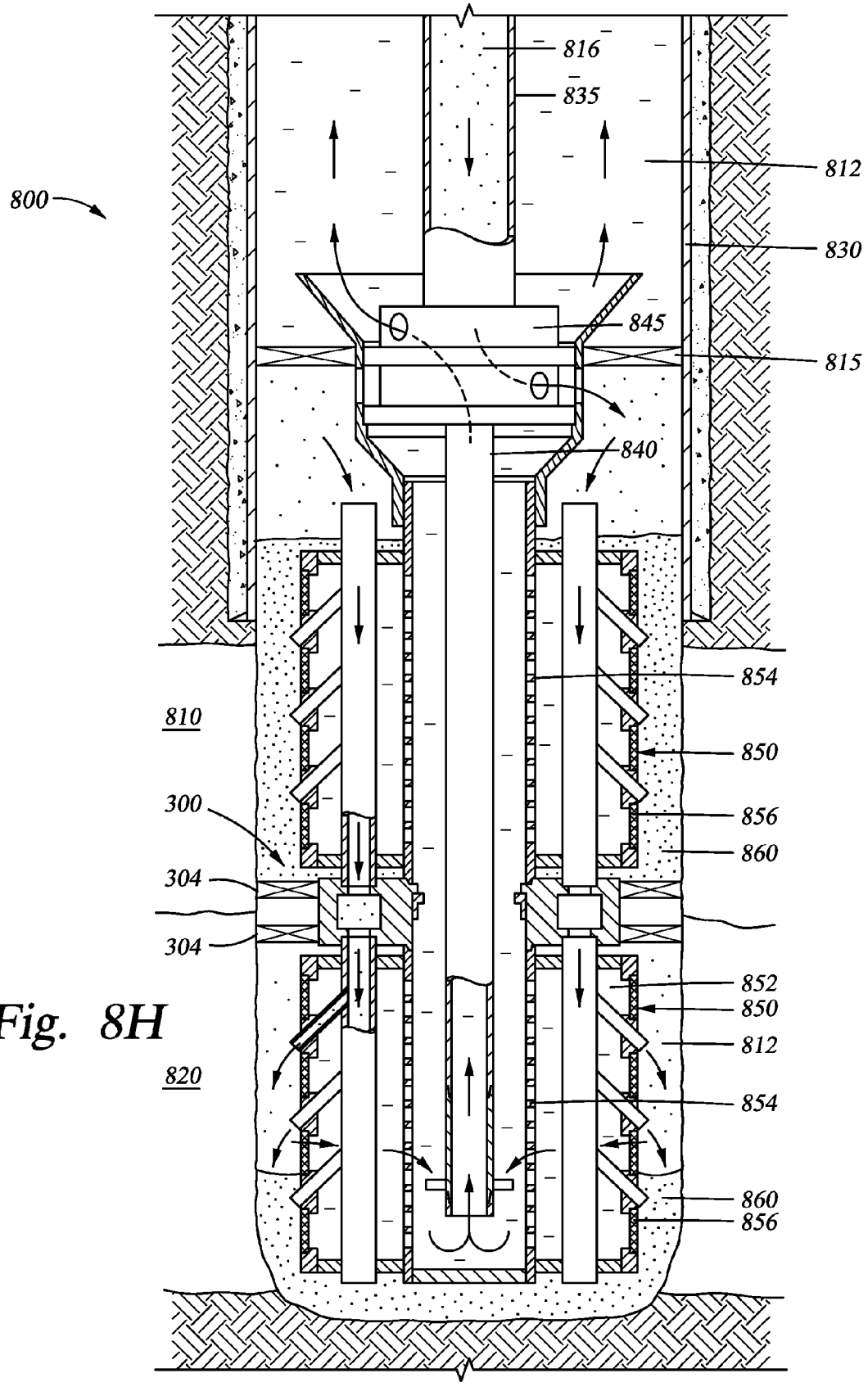
Figure 8I:
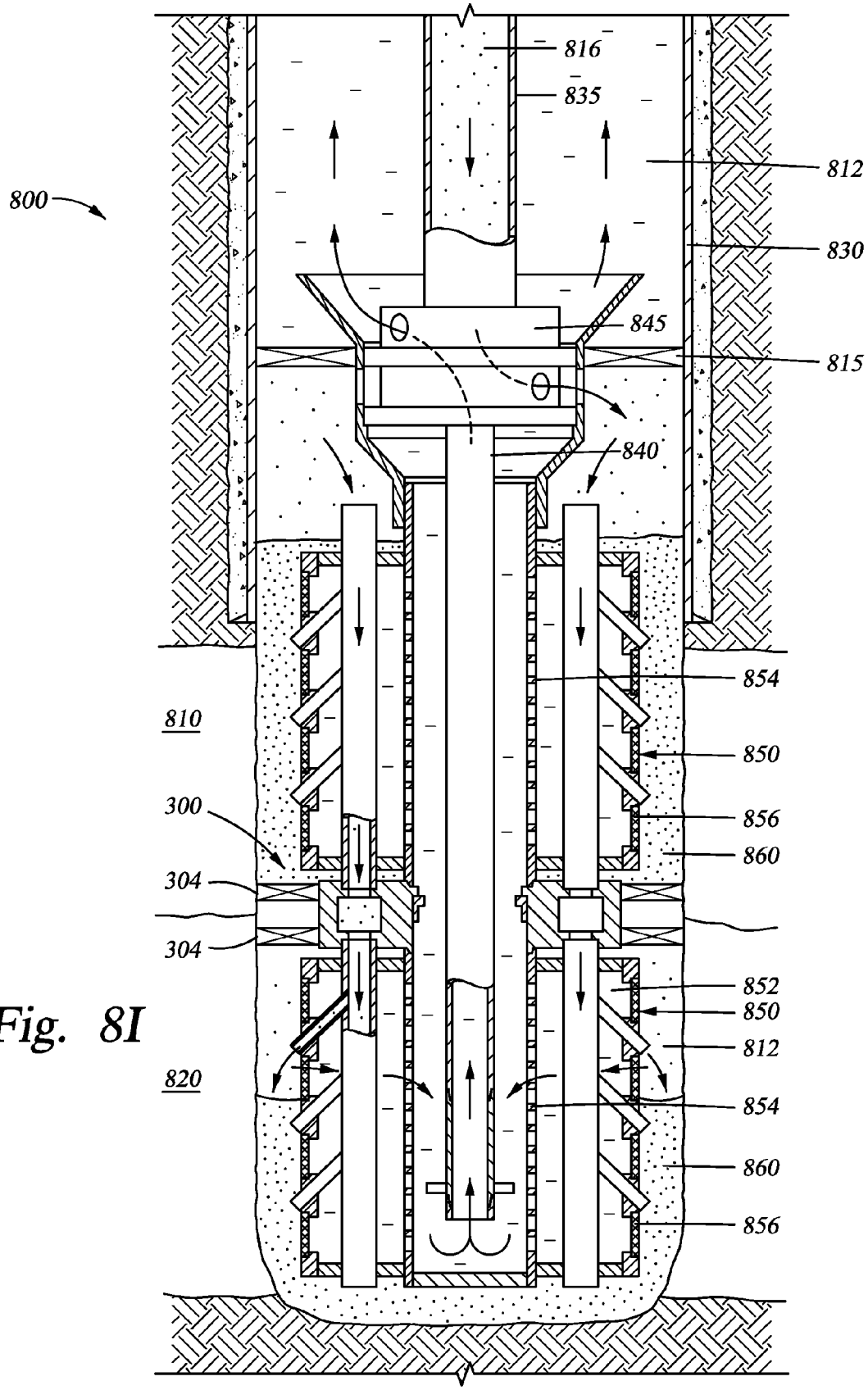
Figure 8J:
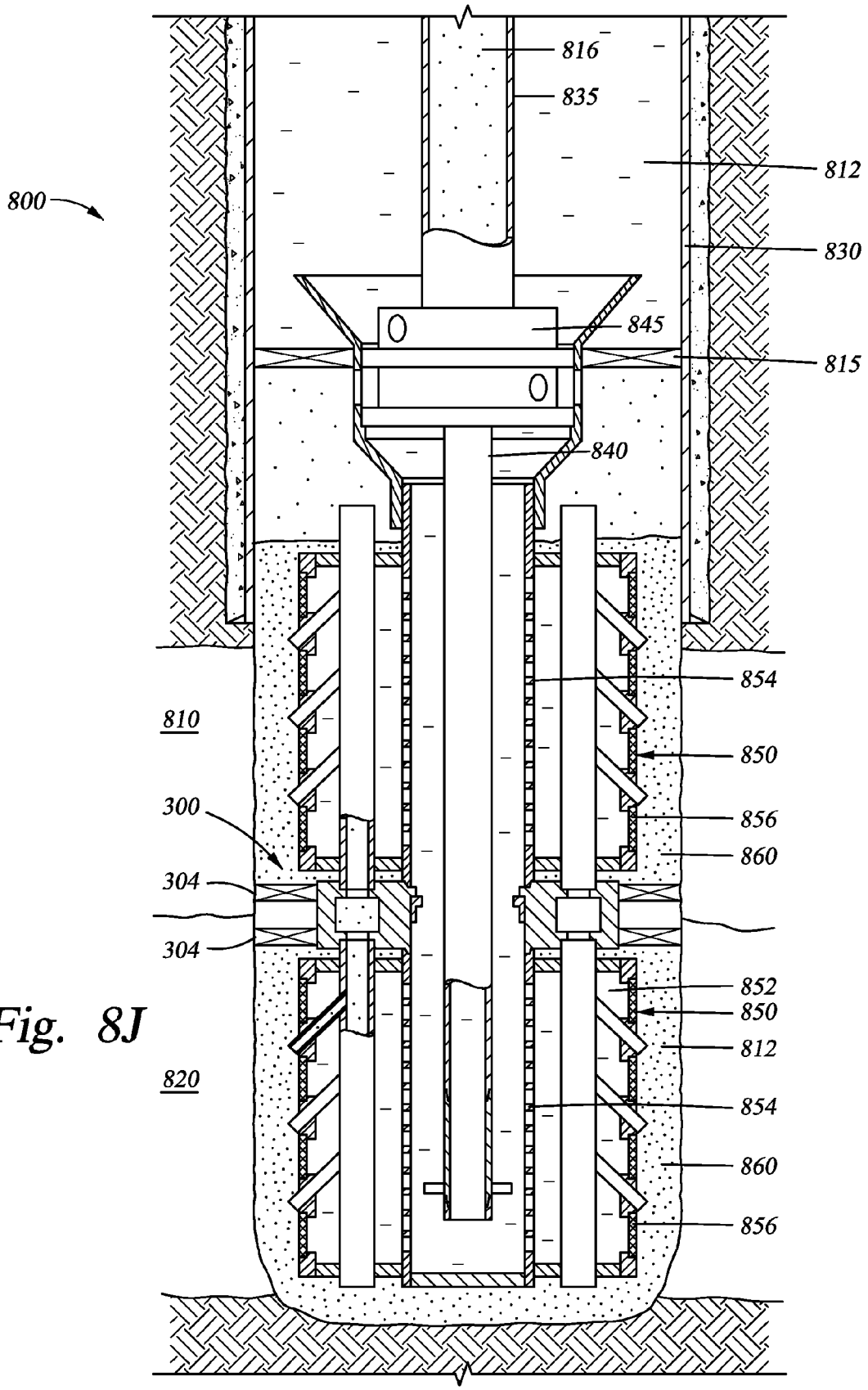

In FIG. 8H, the gravel pack 860 is beginning to form below the packer 300 and around the sand screen 856. In FIG. 8I, the gravel packing continues to grow the gravel pack 860 from the bottom of the wellbore 800 up toward the packer 300. In FIG. 8J, the gravel pack 860 has been formed from the bottom of the wellbore 800 up to the packer 300. The sand screen 856 below the packer 300 has been covered by gravel pack 860. The surface treating pressure increases to indicate that the annular space between the sand screens 856 and the wall 805 of the wellbore 800 is fully gravel packed.

Figure 8K:
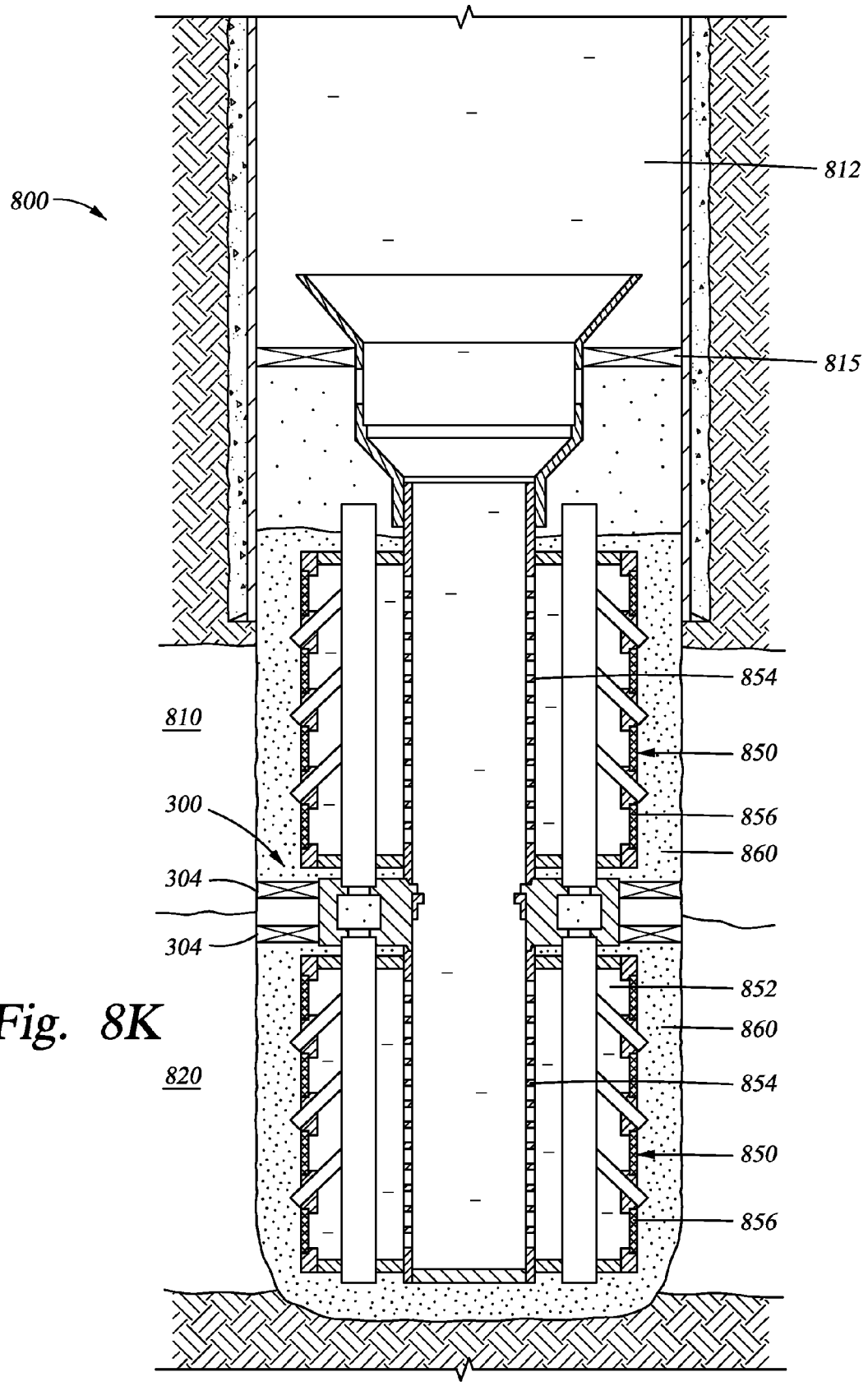
FIG. 8K shows the packer assembly and gravel pack having been set in an open-hole wellbore following completion of the gravel packing procedure from FIGS. 8A through 8K.

FIG. 8K shows the drill string 835 and the washpipe 840 from FIGS. 8A through 8J having been removed from the wellbore 800. The casing 830, the base pipes 854, and the sand screens 856 remain in the wellbore 800 along the upper 810 and lower 820 production intervals. Packer 300 and the gravel packs 860 remain set in the open hole wellbore 800 following completion of the gravel packing procedure from FIGS. 8A through 8J. The wellbore 800 is now ready for production operations.

As mentioned above, once a wellbore has undergone gravel packing, the operator may choose to isolate a selected interval in the wellbore, and discontinue production from that interval. To demonstrate how a wellbore interval may be isolated, FIGS. 9A and 9B are provided.

Figure 9A:
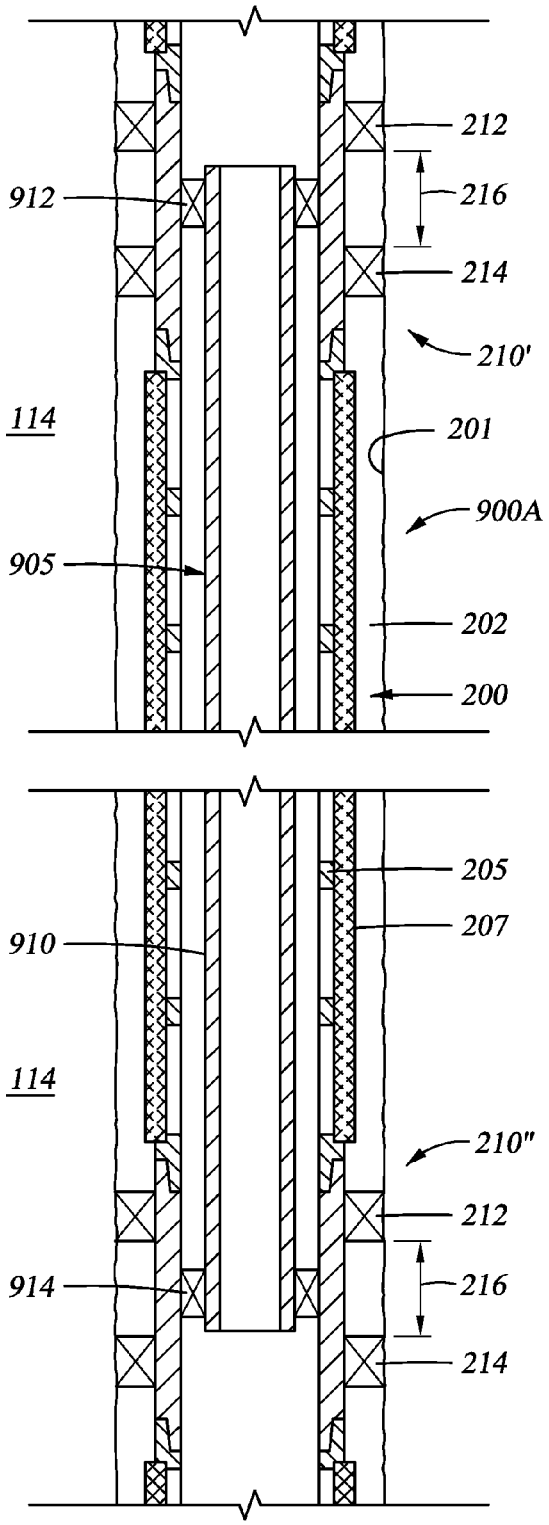
FIG. 9A is a cross-sectional view of a middle interval of the open-hole completion of FIG. 2. Here, a straddle packer has been placed within a sand control device across the middle interval to prevent the inflow of formation fluids.
Figure 9B:
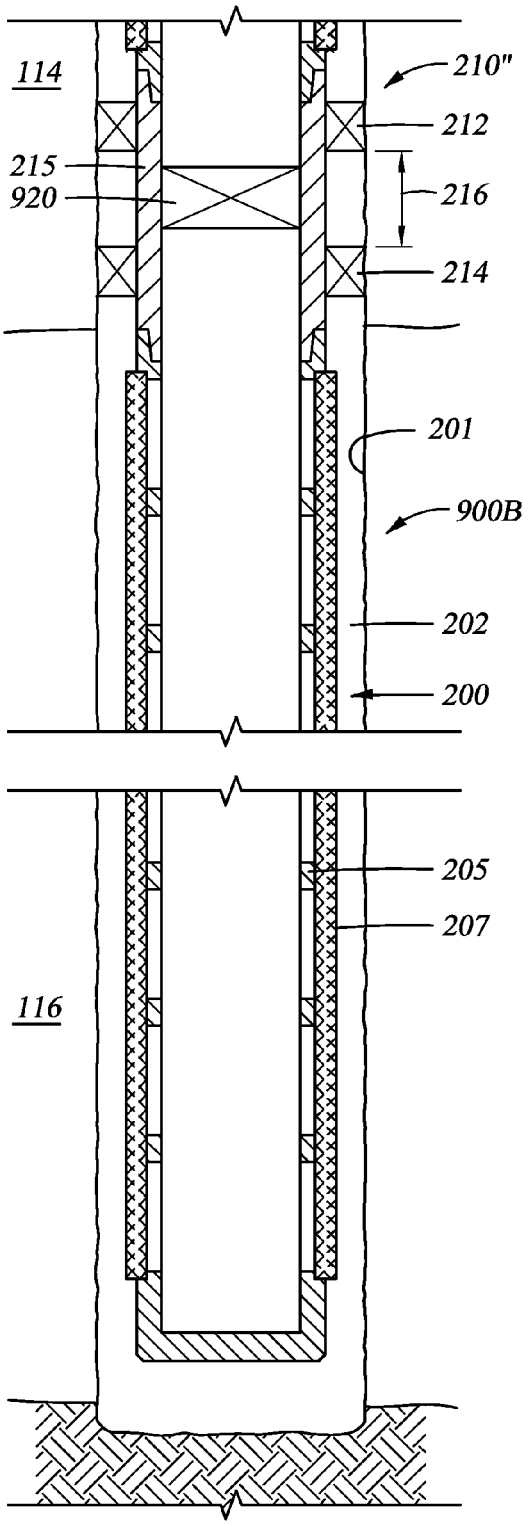
FIG. 9B is a cross-sectional view of middle and lower intervals of the open-hole completion of FIG. 2. Here, a plug has been placed within a packer assembly between the middle and lower intervals to prevent the flow of formation fluids up the wellbore from the lower interval.

First, FIG. 9A is a cross-sectional view of a wellbore 900A. The wellbore 900A is generally constructed in accordance with wellbore 100 of FIG. 2. In FIG. 9A, the wellbore 900A is shown intersecting through a subsurface interval 114. Interval 114 represents an intermediate interval. This means that there is also an upper interval 112 and a lower interval 116 (seen in FIG. 2, but not shown in FIG. 9A).

The subsurface interval 114 may be a portion of a subsurface formation that once produced hydrocarbons in commercially viable quantities but has now suffered significant water or hydrocarbon gas encroachment. Alternatively, the subsurface interval 114 may be a formation that was originally a water zone or aquitard or is otherwise substantially saturated with aqueous fluid. In either instance, the operator has decided to seal off the influx of formation fluids from interval 114 into the wellbore 900A.

A sand screen 200 has been placed in the wellbore 900A. Sand screen 200 is in accordance with the sand control device 200 of FIG. 2. In addition, a base pipe 205 is seen extending through the intermediate interval 114. The base pipe 205 is part of the sand screen 200. The sand screen 200 also includes a mesh screen, a wire-wrapped screen, or other radial filter medium 207. The base pipe 205 and surrounding filter medium 207 preferably comprise a series of joints connected end-to-end. The joints are ideally about 5 to 45 feet in length.

The wellbore 900A has an upper packer assembly 210' and a lower packer assembly 210". The upper packer assembly 210' is disposed near the interface of the upper interval 112 and the intermediate interval 114, while the lower packer assembly 210" is disposed near the interface of the intermediate interval 114 and the lower interval 116. Each packer assembly 210', 210" is preferably in accordance with packer assembly 300 of FIGS. 3A and 3B. In this respect, the packer assemblies 210', 210" will each have opposing mechanically-set packers 304. The mechanically-set packers are shown in FIG. 9A at 212 and 214. The mechanically-set packers 212, 214 may be in accordance with packer 600 of FIGS. 6A and 6B. The packers 212, 214 are spaced apart as shown by spacing 216.

The dual packers 212, 214 are mirror images of each other, except for the release sleeves (e.g., release sleeve 710 and associated shear pin 720). As noted above, unilateral movement of a shifting tool (such as shifting tool 750) shears the shear pins 720 and moves the release sleeves 710. This allows the packer elements 655 to be activated in sequence, the lower one first, and then the upper one.

The wellbore 900A is completed as an open-hole completion. A gravel pack has been placed in the wellbore 900A to help guard against the inflow of granular particles. Gravel packing is indicated as spackles in the annulus 202 between the filter media 207 of the sand screen 200 and the surrounding wall 201 of the wellbore 900A.

In the arrangement of FIG. 9A, the operator desires to continue producing formation fluids from upper 112 and lower 116 intervals while sealing off intermediate interval 114. The upper 112 and lower 116 intervals are formed from sand or other rock matrix that is permeable to fluid flow. To accomplish this, a straddle packer 905 has been placed within the sand screen 200. The straddle packer 905 is placed substantially across the intermediate interval 114 to prevent the inflow of formation fluids from the intermediate interval 114.

The straddle packer 905 comprises a mandrel 910. The mandrel 910 is an elongated tubular body having an upper end adjacent the upper packer assembly 210', and a lower end adjacent the lower packer assembly 210". The straddle packer 905 also comprises a pair of annular packers. These represent an upper packer 912 adjacent the upper packer assembly 210', and a lower packer 914 adjacent the lower packer assembly 210". The novel combination of the upper packer assembly 210' with the upper packer 912, and the lower packer assembly 210" with the lower packer 914 allows the operator to successfully isolate a subsurface interval such as intermediate interval 114 in an open-hole completion.

Another technique for isolating an interval along an open-hole formation is shown in FIG. 9B. FIG. 9B is a side view of a wellbore 900B. Wellbore 900B may again be in accordance with wellbore 100 of FIG. 2. Here, the lower interval 116 of the open-hole completion is shown. The lower interval 116 extends essentially to the bottom 136 of the wellbore 900B and is the lowermost zone of interest.

In this instance, the subsurface interval 116 may be a portion of a subsurface formation that once produced hydrocarbons in commercially viable quantities but has now suffered significant water or hydrocarbon gas encroachment. Alternatively, the subsurface interval 116 may be a formation that was originally a water zone or aquitard or is otherwise substantially saturated with aqueous fluid. In either instance, the operator has decided to seal off the influx of formation fluids from the lower interval 116 into the wellbore 100.

To accomplish this, a plug 920 has been placed within the wellbore 100. Specifically, the plug 920 has been set in the mandrel 215 supporting the lower packer assembly 210". Of the two packer assemblies 210', 210", only the lower packer assembly 210" is seen. By positioning the plug 920 in the lower packer assembly 210", the plug 920 is able to prevent the flow of formation fluids up the wellbore 200 from the lower interval 116.

It is noted that in connection with the arrangement of FIG. 9B, the intermediate interval 114 may comprise a shale or other rock matrix that is substantially impermeable to fluid flow. In this situation, the plug 920 need not be placed adjacent the lower packer assembly 210"; instead, the plug 920 may be placed anywhere above the lower interval 116 and along the intermediate interval 114. Further, in this instance the upper packer assembly 210' need not be positioned at the top of the intermediate interval 114; instead, the upper packer assembly 210' may also be placed anywhere along the intermediate interval 114. If the intermediate interval 114 is comprised of unproductive shale, the operator may choose to place blank pipe across this region, with alternate flow channels, i.e. transport tubes, along the intermediate interval 114.

Figure 10:
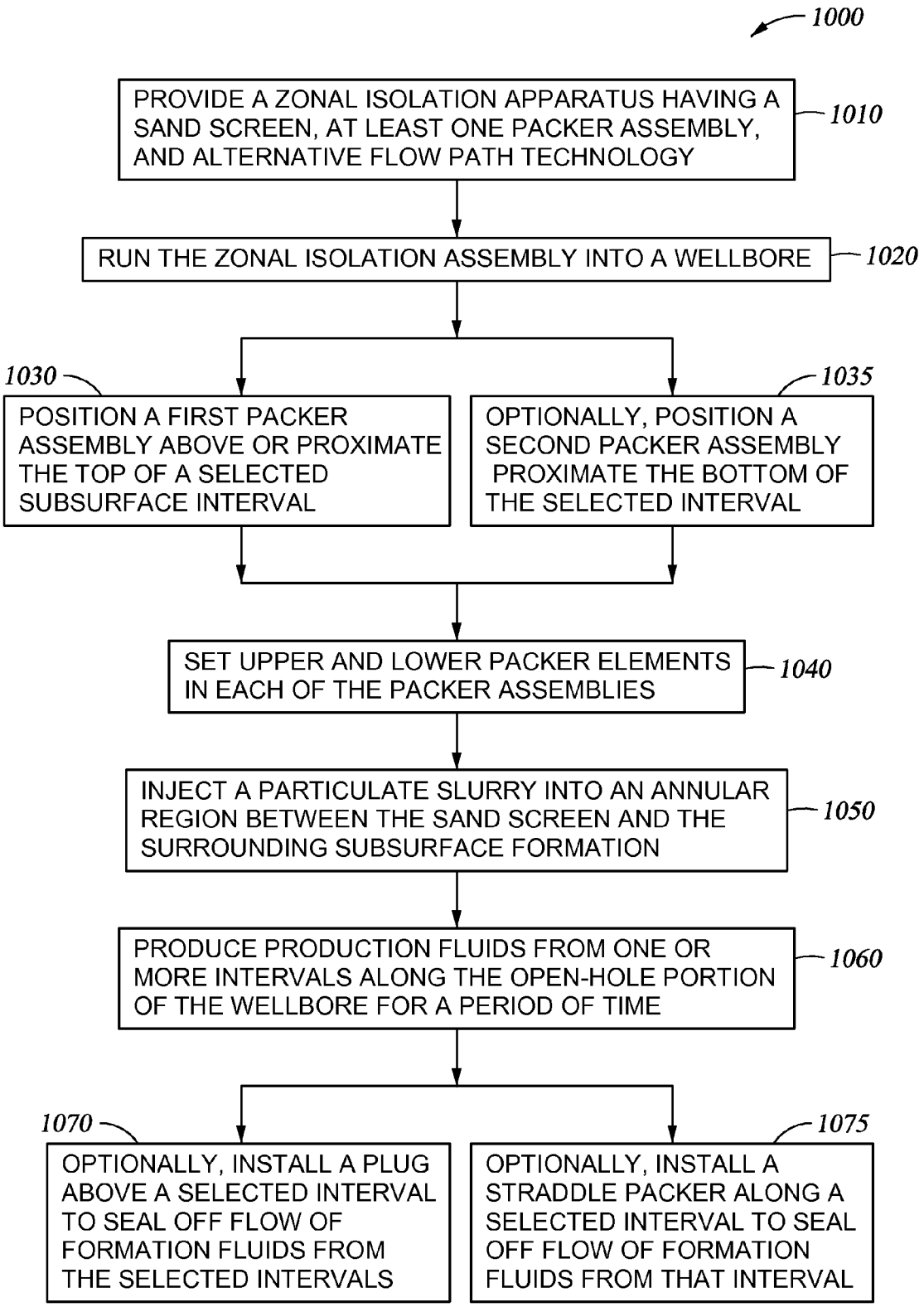
FIG. 10 is a flowchart showing steps that may be performed in connection with a method for completing an open-hole wellbore, in one embodiment.

A method 1000 for completing a wellbore is also provided herein. The method 1000 is presented in FIG. 10. FIG. 10 provides a flowchart presenting steps for a method 1000 of completing a wellbore, in various embodiments. Preferably, the wellbore is an open-hole wellbore.

The method 1000 includes providing a zonal isolation apparatus. This is shown at Box 1010 of FIG. 10. The zonal isolation apparatus is preferably in accordance with the components described above in connection with FIG. 2. In this respect, the zonal isolation apparatus may first include a sand screen. The sand screen will represent a base pipe and a surrounding mesh or wound wire. The zonal isolation apparatus will also have at least one packer assembly. The packer assembly will have at least one mechanically-set packer, with the mechanically-set packer having alternate flow channels.

Preferably, the packer assembly will have at least two mechanically set packers. Alternate flow channels will travel through each of the mechanically-set packers. Preferably, the zonal isolation apparatus will comprise at least two packer assemblies separated by sand screen joints or blank joints or some combination thereof.

The method 1000 also includes running the zonal isolation apparatus into the wellbore. The step of running the zonal isolation apparatus into the wellbore is shown at Box 1020. The zonal isolation apparatus is run into a lower portion of the wellbore, which is preferably completed as an open-hole.

The open-hole portion of the wellbore may be completed substantially vertically. Alternatively, the open-hole portion may be deviated, or even horizontal.

The method 1000 also includes positioning the zonal isolation apparatus in the wellbore. This is shown in FIG. 10 at Box 1030. The step of positioning the zonal isolation apparatus is preferably done by hanging the zonal isolation apparatus from a lower portion of a string of production casing. The apparatus is positioned such that the sand screen is adjacent one or more selected production intervals along the open-hole portion of the wellbore. Further, a first of the at least one packer assembly is positioned above or proximate the top of a selected subsurface interval.

In one embodiment, the wellbore traverses through three separate intervals. These include an upper interval from which hydrocarbons are produced, and a lower interval from which hydrocarbons are no longer being produced in economically viable volumes. Such intervals may be formed of sand or other permeable rock matrix. The intervals may also include an intermediate interval from which hydrocarbons are not produced. The formation along the intermediate interval may be formed of shale or other substantially impermeable material. The operator may choose to position the first of the at least one packer assembly near the top of the lower interval or anywhere along the non-permeable intermediate interval.

In one aspect, the at least one packer assembly is placed proximate a top of an intermediate interval. Optionally, a second packer assembly is positioned proximate the bottom of a selected interval such as the intermediate interval. This is shown in Box 1035.

The method 1000 next includes setting the mechanically set packer elements in each of the at least one packer assembly. This is provided in Box 1040. Mechanically setting the upper and lower packer elements means that an elastomeric (or other) sealing member engages the surrounding wellbore wall. The packer elements isolate an annular region formed between the sand screens and the surrounding subsurface formation above and below the packer assemblies.

Beneficially, the step of setting the packer of Box 1040 is provided before slurry is injected into the annular region. Setting the packer provides a hydraulic and mechanical seal to the wellbore before any gravel is placed around the elastomeric element. This provides a better seal during the gravel packing operation.

The step of Box 1040 may be accomplished by using the packer 600 of FIGS. 6A and 6B. The open-hole, mechanically-set packer 600 enables gravel pack completions to gain the current flexibility of standalone screen (SAS) applications by providing future zonal isolation of unwanted fluids while enjoying the benefits of reliability of an alternate path gravel pack completion.

Figure 11:
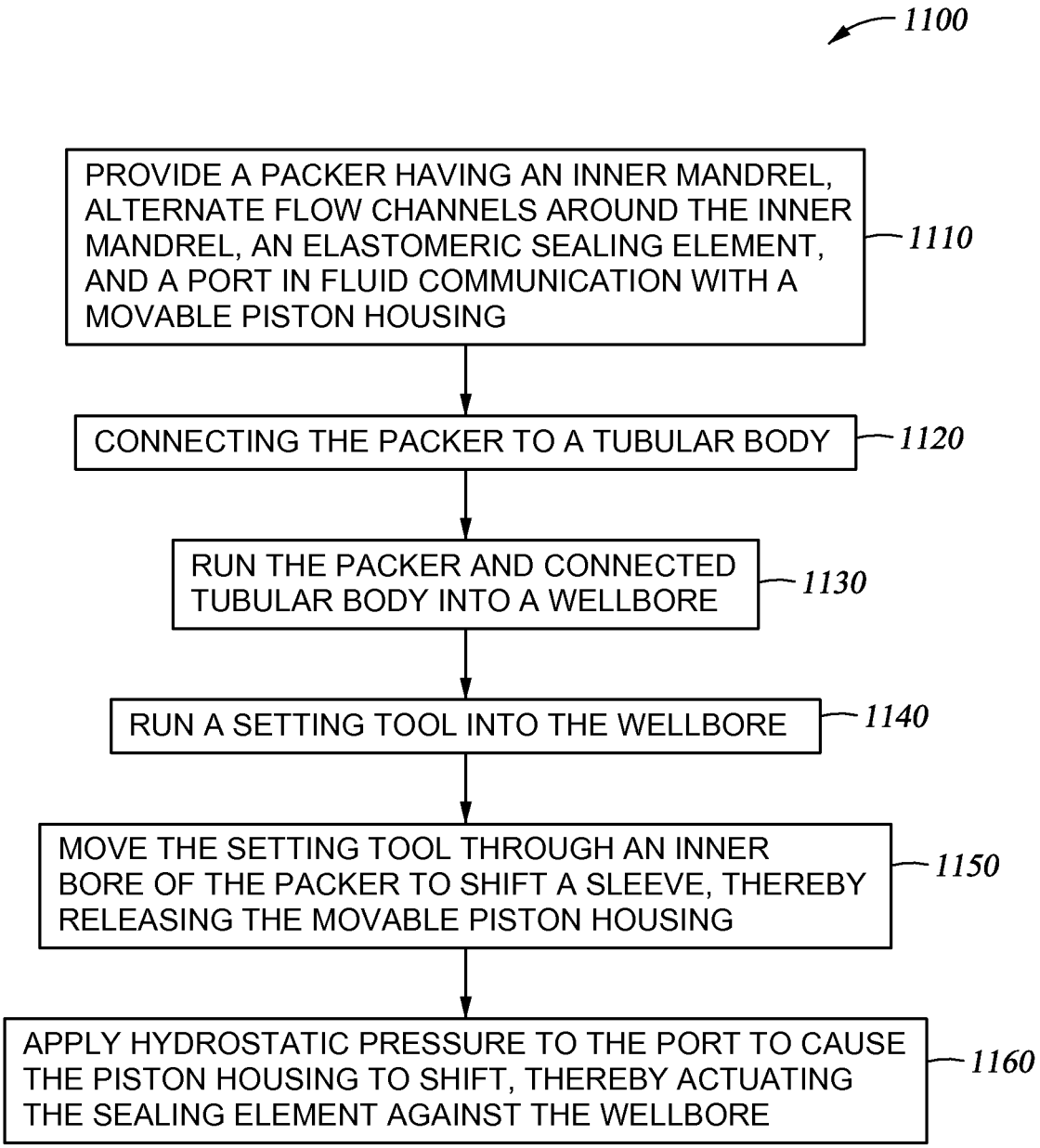
FIG. 11 is a flowchart that provides steps for a method of setting a packer, in one embodiment. The packer is set in an open-hole wellbore, and includes alternate flow channels.

FIG. 11 is a flowchart that provides steps that may be used, in one embodiment, for a method 1100 of setting a packer. The method 110 first includes providing the packer. This is shown at Box 1110. The packer may be in accordance with packer 600 of FIGS. 6A and 6B. Thus, the packer is a mechanically-set packer that is set against an open-hole wellbore to seal an annulus.

Fundamentally, the packer will have an inner mandrel, and alternate flow channels around the inner mandrel. The packer may further have a movable piston housing and an elastomeric sealing element. The sealing element is operatively connected to the piston housing. This means that sliding the movable piston housing along the packer (relative to the inner mandrel) will actuate the sealing element into engagement with the surrounding wellbore.

The packer may also have a port. The port is in fluid communication with the piston housing. Hydrostatic pressure within the wellbore communicates with the port. This, in turn, applies fluid pressure to the piston housing. Movement of the piston housing along the packer in response to hydrostatic pressure causes the elastomeric sealing element to be expanded into engagement with the surrounding wellbore.

It is preferred that the packer also have a centralizing system. An example is the centralizer 660 of FIGS. 6A and 6B. It is also preferred that mechanical force used to actuate the sealing element be applied by the piston housing through the centralizing system. In this way, both the centralizers and the sealing element are set through the same hydrostatic force.

The method 1100 also includes connecting the packer to a tubular body. This is provided at Box 1120. The tubular body may be a blank pipe or a downhole sensing tool equipped with alternate flow channels. However, it is preferred that the tubular body be a sand screen equipped with alternate flow channels.

Preferably, the packer is one of two mechanically-set packers having cup-type sealing elements. The packer assembly is placed within a string of sand screens or blanks equipped with alternate flow channels.

Regardless of the arrangement, the method 1100 also includes running the packer and the connected tubular body into a wellbore. This is shown at Box 1130. In addition, the method 1100 includes running a setting tool into the wellbore. This is provided at Box 1140. Preferably, the packer and connected sand screen are run first, followed by the setting tool. The setting tool may be in accordance with exemplary setting tool 750 of FIG. 7C. Preferably, the setting tool is part of or is run in with a washpipe.

The method 1100 next includes moving the setting tool through the inner mandrel of the packer. This is shown at Box 1150. The setting tool is translated within the wellbore through mechanical force. Preferably, the setting tool is at the end of a working string such as coiled tubing.

Movement of the setting tool through the inner mandrel causes the setting tool to shift a sleeve along the inner mandrel. In one aspect, shifting the sleeve will shear one or more shear pins. In any aspect, shifting the sleeve releases the piston housing, permitting the piston housing to shift or to slide along the packer relative to the inner mandrel. As noted above, this movement of the piston housing permits the sealing element to be actuated against the wall of the surrounding open-hole wellbore.

In connection with the moving step of Box 1150, the method 1100 also includes communicating hydrostatic pressure to the port. This is seen in Box 1160. Communicating hydrostatic pressure means that the wellbore has sufficient energy stored in a column of fluid to create a hydrostatic head, wherein the hydrostatic head acts against a surface or shoulder on the piston housing. The hydrostatic pressure includes pressure from fluids in the wellbore, whether such fluids are completion fluids or reservoir fluids, and may also include pressure contributed downhole by a reservoir. Because the shear pins (including set screws) have been sheared, the piston housing is free to move.

Returning back to FIG. 10, the method 1000 for completing an open-hole wellbore also includes injecting a particulate slurry into the annular region. This is demonstrated in Box 1050. The particulate slurry is made up of a carrier fluid and sand (and/or other) particles. One or more alternate flow channels allow the particulate slurry to bypass the sealing elements of the mechanically-set packers. In this way, the open-hole portion of the wellbore is gravel-packed below, or above and below (but not between), the mechanically-set packer elements.

It is noted that the sequence for annulus pack-off may vary. For example, if a premature sand bridge is formed during gravel packing, the annulus above the bridge will continue to be gravel packed via fluid leak-off through the sand screen due to the alternate flow channels. In this respect, some slurry will flow into and through the alternate flow channels to bypass the premature sand bridge and deposit a gravel pack. As the annulus above the premature sand bridge is nearly completely packed, slurry is increasingly diverted into and through the alternate flow channels. Here, both the premature sand bridge and the packer will be bypassed so that the annulus is gravel packed below the packer.

It is also possible that a premature sand bridge may form below the packer. Any voids above or below the packer will eventually be packed by the alternate flow channels until the entire annulus is fully gravel packed.

During pumping operations, once gravel covers the screens above the packer, slurry is diverted into the shunt tubes, then passes through the packer, and continues to pack below the packer via the shunt tubes (or alternate flow channels) with side ports allowing slurry to exit into the wellbore annulus. The hardware provides the ability to seal off bottom water, selectively complete or gravel pack targeted intervals, perform a stacked open-hole completion, or isolate a gas/water-bearing sand following production. The hardware further allows for selective stimulation, selective water or gas injection, or selective chemical treatment for damage removal or sand consolidation.

The method 1000 further includes producing production fluids from intervals along the open-hole portion of the wellbore. This is provided at Box 1060. Production takes place for a period of time.

In one embodiment of the method 1000, flow from a selected interval may be sealed from flowing into the wellbore. For example, a plug may be installed in the base pipe of the sand screen above or near the top of a selected subsurface interval. This is shown at Box 1070. Such a plug may be used at or below the lowest packer assembly, such as the second packer assembly from step 1035.

In another example, a straddle packer is placed along the base pipe along a selected subsurface interval to be sealed. This is shown at Box 1075. Such a straddle may involve placement of sealing elements adjacent upper and lower packer assemblies (such as packer assemblies 210', 210" of FIG. 2 or FIG. 9A) along a mandrel.

Other embodiments of sand control devices 200 may be used with the apparatuses and methods herein. For example, the sand control devices may include stand-alone screens (SAS), pre-packed screens, or membrane screens. The joints may be any combination of screen, blank pipe, or zonal isolation apparatus.

The downhole packer may be used for formation isolation in contexts other than production. For example, the method may further comprise injecting a solution from an earth surface, through the inner mandrel below the packer, and into a subsurface formation. The solution may be, for example, and aqueous solution, an acidic solution, or a chemical treatment. The method may then further comprise circulating the aqueous solution, the acidic solution, or the chemical treatment to clean a near-wellbore region along the open-hole portion of the wellbore. This may be done before or after production operations begin. Alternatively, the solution may be an aqueous solution, and the method may further comprise continuing to inject the aqueous solution into the subsurface formation as part of an enhanced oil recovery operation. This would preferably be in lieu of production from the wellbore.

While it will be apparent that the inventions herein described are well calculated to achieve the benefits and advantages set forth above, it will be appreciated that the inventions are susceptible to modification, variation and change without departing from the spirit thereof. Improved methods for completing an open-hole wellbore are provided so as to seal off one or more selected subsurface intervals. An improved zonal isolation apparatus is also provided. The inventions permit an operator to produce fluids from or to inject fluids into a selected subsurface interval.

What is claimed is:

1. A method for completing a wellbore in a subsurface formation, the method comprising:

providing a packer, the packer comprising:

an inner mandrel, alternate flow channels along the inner mandrel, a movable piston housing retained around the inner mandrel, one or more flow ports providing fluid communication between the alternate flow channels and a pressure-bearing surface of the piston housing, and a sealing element external to the inner mandrel;

connecting the packer to a tubular body;

running the packer and connected tubular body into the wellbore;

running a setting tool into the inner mandrel of the packer;

manipulating the setting tool to mechanically release the movable piston housing from its retained position;

setting the packer by communicating hydrostatic pressure to the piston housing through the one or more flow ports, thereby moving the released piston housing to actuate the sealing element into engagement with the surrounding wellbore;

injecting a gravel slurry into an annular region formed between the tubular body and the surrounding wellbore; and injecting the gravel slurry through the alternate flow channels to allow the gravel slurry to at least partially bypass the sealing element so that the wellbore is gravel-packed within the annular region below the packer.

2. The method of claim 1, wherein the injecting steps take place after the packer has been set in the wellbore.

3. The method of claim 2, wherein:

the wellbore has a lower end defining an open-hole portion;

the packer and tubular body are run into the wellbore along the open-hole portion;

the packer is set within the open-hole portion of the wellbore;

the tubular body is (i) a sand screen comprising a base pipe, alternate flow channels, and a surrounding filter medium, or (ii) a blank pipe having alternate flow channels; and the base pipe or the blank pipe is made up of a plurality of joints.

4. The method of claim 3, further comprising:

connecting the packer between two of the plurality of joints of the base pipe.

5. The method of claim 3, wherein the packer is a first mechanically-set packer that is part of a packer assembly.

6. The method of claim 5, wherein the packer assembly comprises:

the first mechanically-set packer; and a second mechanically-set packer spaced apart from the first mechanically-set packer, the second mechanically-set packer being substantially a mirror image of or substantially identical to the first mechanically-set packer.

7. The method of claim 6, wherein each of the first and second packers further comprises:

a movable piston housing retained around the inner mandrel; and one or more flow ports providing fluid communication between the alternate flow channels and a pressure-bearing surface of the piston housing.

8. The method of claim 7, further comprising:

running a setting tool into the inner mandrel of each of the packers;

manipulating the setting tool to mechanically release the movable piston housing from its retained position along each of the respective first and second packers; and communicating hydrostatic pressure to the piston housings through the one or more flow ports, thereby moving the released piston housings and actuating the sealing element of each of the first and second packers against the surrounding wellbore.

9. The method of claim 8, wherein:

running the setting tool comprises running a washpipe into a bore within the inner mandrels of the respective first and second packers, the washpipe having the setting tool thereon; and releasing the movable piston housing from its retained position comprises pulling the washpipe with the setting tool along the inner mandrels of the respective first and second packers, thereby shifting release sleeves in each of the first and second packers, and shearing respective shear pins.

10. The method of claim 3, further comprising:

producing hydrocarbon fluids from at least one interval along the open-hole portion of the wellbore.

11. The method of claim 3, wherein:

the packer further comprises a centralizer; and setting the packer further comprises actuating the centralizer into engagement with the surrounding open-hole portion of the wellbore.

12. The method of claim 2, wherein the step of injecting the gravel slurry through the alternate flow channels comprises bypassing the sealing element so that the open-hole portion of the wellbore is gravel-packed above and below the packer after the packer has been set in the wellbore.

13. The method of claim 1, wherein:

the packer further comprises a release sleeve along an inner surface of the inner mandrel; and manipulating the setting tool comprises pulling the setting tool through the inner mandrel to shift the release sleeve.

14. The method of claim 13, wherein shifting the release sleeve shears at least one shear pin.

15. The method of claim 14, wherein:

running the setting tool comprises running a washpipe into a bore within the inner mandrel of the packer, the washpipe having the setting tool thereon; and releasing the movable piston housing from its retained position comprises pulling the washpipe with the setting tool along the inner mandrel, thereby shifting the release sleeve and shearing the at least one shear pin.

16. The method of claim 15, wherein the sealing element is an elastomeric cup-type element.

17. The method of claim 15, wherein:

the packer further comprises a centralizer; and releasing the piston housing further actuates the centralizer into engagement with the surrounding open-hole portion of the wellbore.

18. The method of claim 17, wherein communicating hydrostatic pressure to the piston housing moves the piston housing to actuate the centralizer, which in turn actuates the sealing element against the surrounding wellbore.

19. The method of claim 1, wherein setting the packer comprises setting the packer along either a non-perforated joint of casing, or an open-hole portion.

20. A downhole packer for sealing an annular region between a tubular body and a surrounding wellbore, comprising:

an inner mandrel;

an alternate flow channel along the inner mandrel;

a sealing element external to the inner mandrel and residing circumferentially around the inner mandrel;

a movable piston housing retained around the inner mandrel, the movable piston housing having a pressure-bearing surface at a first end, and being operatively connected to the sealing element, wherein the piston housing acts against the sealing element in response to hydrostatic pressure;

one or more flow ports providing fluid communication between the alternate flow channels and the pressure-bearing surface of the piston housing;

a release sleeve along an inner surface of the inner mandrel; and a release key connected to the release sleeve, the release key being movable between a retaining position wherein the release key engages and retains the moveable piston housing in place, to a releasing position wherein the release key disengages the piston housing, thereby permitting the hydrostatic pressure to act against the pressure-bearing surface of the piston housing and move the piston housing along the inner mandrel to actuate the sealing element.

21. The downhole packer of claim 20, further comprising:
at least one shear pin releasably connecting the release sleeve to the release key.

22. The downhole packer of claim 20, wherein the sealing element is an elastomeric cup-type element.

23. The downhole packer of claim 20, wherein the sealing element is about 6 inches (15.2 cm) to 24 inches (61 cm) in length.

24. The downhole packer of claim 23, further comprising:
a centralizer having extendable fingers, the fingers extending in response to movement of the piston housing.

25. The downhole packer of claim 24, wherein:
the centralizer is disposed around the inner mandrel between the piston housing and the sealing element; and
the downhole packer is configured so that force applied by the piston housing against the centralizer actuates the sealing element against the surrounding wellbore.

26. The downhole packer of claim 20, further comprising:
a piston mandrel disposed circumferentially around the inner mandrel;
an annulus provided between the inner mandrel and the surrounding piston mandrel, wherein the annulus defines the alternate flow channel; and
wherein the one or more flow ports is disposed within the piston mandrel.

27. The downhole packer of claim 26, wherein the piston housing and the sealing element reside circumferentially around the piston mandrel.

28. The downhole packer of claim 26, further comprising:
a metering orifice configured to regulate a rate at which the piston housing translates along the piston mandrel, thereby slowing the movement of the piston housing and regulating the setting speed for the packer.

29. The downhole packer of claim 26, further comprising:
a load shoulder disposed around the piston mandrel at an upper end, and configured to support the packer during make-up with a working string.

30. The downhole packer of claim 26, further comprising:
a coupling connected to the piston mandrel at the upper end, the coupling defining a tubular body configured to receive the inner mandrel, and to form a part of the alternate flow channel between the inner mandrel and the surrounding coupling.

31. A method for setting a packer within a wellbore, comprising:
providing a packer, the packer comprising:
an inner mandrel,
alternate flow channels along the inner mandrel,
a movable piston housing retained around the inner mandrel,
one or more flow ports providing fluid communication between the alternate flow channels and a pressure-bearing surface of the piston housing, and
a sealing element external to the inner mandrel;
connecting the packer to a tubular body;
running the packer and connected tubular body into the wellbore;
running a setting tool into the inner mandrel of the packer;
pulling the setting tool to mechanically shift a release sleeve from a retained position along the inner mandrel of the packer, thereby releasing the piston housing for axial movement; and
communicating hydrostatic pressure to the piston housing through the one or more flow ports, thereby axially moving the released piston housing and actuating the sealing element against the surrounding wellbore.

32. The method of claim 31, wherein:
the wellbore has a lower end defining an open-hole portion;
running the packer into the wellbore comprises running the packer into the open-hole portion of the wellbore;
the tubular body is (i) a sand screen comprising a base pipe, alternate flow channels, and a surrounding filter medium, or (ii) a blank pipe comprising alternate flow channels; and
the method further comprises:
injecting a gravel slurry into an annular region formed between the tubular body and the surrounding open-hole portion of the wellbore, and
further injecting the gravel slurry through the alternate flow channels to allow the gravel slurry to bypass the sealing element so that the open-hole portion of the wellbore is gravel-packed below the packer after the packer has been set in the wellbore.

33. The method of claim 32, wherein the step of further injecting the gravel slurry through the alternate flow channels comprises bypassing the sealing element so that the open-hole portion of the wellbore is gravel-packed above and below the packer after the packer has been set in the wellbore.

34. The method of claim 32, wherein:
shifting the release sleeve shears at least one shear pin;
running the setting tool comprises running a washpipe into a bore within the inner mandrel of the packer, the washpipe having the setting tool thereon; and
releasing the movable piston housing from its retained position comprises pulling the washpipe with the setting tool along the inner mandrel, thereby shifting the release sleeve and shearing the at least one shear pin.

35. The method of claim 34, wherein the packer further comprises one or more flow ports providing fluid communication between the alternate flow channels and a pressure-bearing surface of the piston housing.

36. The method of claim 35, wherein:
the packer further comprises a centralizer; and
releasing the piston housing further actuates the centralizer into engagement with the surrounding open-hole portion of the wellbore.

37. The method of claim 32, wherein the step of further injecting the gravel slurry through the alternate flow channels comprises bypassing the sealing element so that the open-hole portion of the wellbore is gravel-packed above and below the packer after packer has been set in the wellbore.

38. The method of claim 32, further comprising:
producing formation fluids from a subsurface formation below the packer and up through the inner mandrel of the packer to an earth surface.

39. The method of claim 32, further comprising:
injecting a solution from an earth surface, through the inner mandrel below the packer, and into a subsurface formation.

40. The method of claim 39, wherein:
the solution is aqueous solution, an acidic solution, or a chemical treatment; and
the method further comprises circulating the aqueous solution, the acidic solution, or the chemical treatment to clean a near-wellbore region along the wellbore.

41. The method of claim 39, wherein:
the solution is aqueous solution; and
the method further comprises continuing to inject the aqueous solution into the subsurface formation as part of an enhanced oil recovery operation.

* * * * *